US008942895B2

(12) United States Patent
Nomura et al.

(10) Patent No.: US 8,942,895 B2
(45) Date of Patent: Jan. 27, 2015

(54) DISPLAY SYSTEM OF HYDRAULIC SHOVEL, AND CONTROL METHOD THEREFOR

(75) Inventors: Azumi Nomura, Fujisawa (JP); Takashi Kurihara, Hirakata (JP); Etsuo Fujita, Hirakata (JP); Masao Ando, Oita (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/819,456

(22) PCT Filed: Feb. 8, 2012

(86) PCT No.: PCT/JP2012/052829

§ 371 (c)(1),
(2), (4) Date: Feb. 27, 2013

(87) PCT Pub. No.: WO2012/114869

PCT Pub. Date: Aug. 30, 2012

(65) Prior Publication Data

US 2013/0158787 A1 Jun. 20, 2013

(30) Foreign Application Priority Data

Feb. 22, 2011 (JP) ..... 2011-036197

(51) Int. Cl.

| | |
|---|---|
| ***G06F 7/70*** | (2006.01) |
| ***G06F 19/00*** | (2011.01) |
| ***G06G 7/06*** | (2006.01) |
| ***G06G 7/76*** | (2006.01) |
| ***G01S 1/00*** | (2006.01) |
| ***G01S 5/02*** | (2010.01) |
| ***E02F 9/26*** | (2006.01) |

(52) U.S. Cl.

CPC .. *E02F 9/26* (2013.01); *E02F 9/264* (2013.01)
USPC ..... 701/50; 701/469

(58) Field of Classification Search

CPC ..... E02F 9/20; E02F 9/26; E02F 9/205; E02F 9/2045
USPC ..... 701/50, 469
See application file for complete search history.

(56) References Cited

U.S. PATENT DOCUMENTS

| | | | | |
|---|---|---|---|---|
| 2004/0020083 | A1 * | 2/2004 | Staub et al. | 37/348 |
| 2005/0027420 | A1 * | 2/2005 | Fujishima et al. | 701/50 |
| 2011/0178677 | A1 * | 7/2011 | Finley et al. | 701/33 |

FOREIGN PATENT DOCUMENTS

| | | | |
|---|---|---|---|
| JP | 2001-98585 | A | 4/2001 |
| JP | 2004-68433 | A | 3/2004 |
| JP | 2006-214246 | A | 8/2006 |
| WO | 2004/027164 | A1 | 4/2004 |

OTHER PUBLICATIONS

International Search Report of corresponding PCT Application No. PCT/JP2012/052829.

* cited by examiner

*Primary Examiner* — Imran Mustafa
(74) *Attorney, Agent, or Firm* — Global IP Counselors, LLP

(57) ABSTRACT

A display system in a hydraulic shovel has a calculation unit and a display unit. The calculation unit is configured to calculate a distance between a design surface and a position closest to the design surface among positions of a blade edge of a bucket in a widthwise direction of the blade edge based on positional information for the blade edge and the design surface. The display unit is configured and arranged to display a guidance picture. The guidance picture includes an image showing the positional relationship between the design surface and the blade edge of the bucket, and information indicating the distance between the design surface and the position closest to the design surface.

12 Claims, 17 Drawing Sheets

DISPLAY SYSTEM OF HYDRAULIC SHOVEL, AND CONTROL METHOD THEREFOR

CROSS-REFERENCE TO RELATED APPLICATIONS

This application claims priority to Japanese Patent Application No. 2011-036197 filed on Feb. 22, 2011, the disclosure of which is hereby incorporated herein by reference in its entirety.

TECHNICAL FIELD

The present invention relates to a display system in a hydraulic shovel and a control method therefor.

BACKGROUND ART

In a hydraulic shovel, a work machine comprising a bucket is typically operated by an operator operating an operating lever. At such times, it is difficult for the operator to determine whether, when digging a ditch of a predetermined depth or a slope of a predetermined grade, digging the target shape is being accurately performed only by observing the motions of the work machine. Thus, in the hydraulic shovel display system disclosed in Japanese Patent Application Laid-Open Publication 2004-68433, the positional relationship between the target digging surface and a bucket blade edge is displayed as an image on a monitor. A numerical value displaying the distance between the target digging surface and the blade edge of the bucket is also displayed on the monitor. An operator is thereby capable of properly operating to dig a predetermined target digging surface.

SUMMARY

However, because the blade edge of the bucket has a predetermined size in its widthwise direction, if the blade edge of the bucket is not oriented parallel to the target digging surface, the distance between the blade edge of the bucket and the target digging surface will not be the same at all positions along the blade edge of the bucket in its widthwise direction. For example, taking the distance between the center of the blade edge of the bucket in its widthwise direction and the target digging surface as a reference distance, the distance between an end of the blade edge of the bucket in its widthwise direction and the target digging surface may be less than the reference distance. Conversely; the distance between the end of the blade edge of the bucket in its widthwise direction and the target digging surface may also be greater than the reference distance. In the former case, if the operator performs digging operation referring to the reference distance displayed on the monitor, it could lead to digging the ground beyond the target digging surface. In the latter case, if the operator performs digging operation referring to the reference distance displayed on the monitor, it could become difficult to reach the target digging surface. Thus, it is difficult to perform precise digging operation using the conventional display systems described above, even if referring to the distance between the blade edge of the bucket and the target digging surface displayed on the monitor.

An object of the present invention is to provide a hydraulic shovel display system and a control method therefor allowing digging operation to be performed with precision, A hydraulic shovel display system according to a first aspect of the present invention is a display system in a hydraulic shovel having a work machine comprising a bucket and a main body to which the work machine is attached. The display system comprises a position detector unit, a storage unit, a calculation unit, and a display unit. The position detector unit detects information pertaining to a current position of the hydraulic shovel. The storage unit stores positional information for a design surface indicating a target shape of a work object. The calculation unit calculates a position of the blade edge of the bucket on the basis of information pertaining to the current position of the hydraulic shovel. The calculation unit calculates the distance between the design surface and the position closest to the design surface among positions of the blade edge in the widthwise direction of the blade edge on the basis of positional information for the blade edge and the design surface. The display unit displays a guidance picture. The guidance picture includes an image showing a positional relationship between the design surface and the blade edge of the bucket, and information indicating the distance between the design surface and the closest position.

A display system in a hydraulic shovel according to a second aspect of the present invention is the display system in the hydraulic shovel according to the first aspect, wherein the image showing the positional relationship between the design surface and the blade edge of the bucket includes a head-on view of the bucket. The closest position is also displayed in the head-on view of the bucket.

A display system in a hydraulic shovel according to a third aspect of the present invention is the display system in the hydraulic shovel according to the first aspect, wherein part of the design surface is selected as a target surface. Information indicating the distance between the target surface and the position closest to the target surface among positions of the blade edge in the widthwise direction of the blade edge is also displayed in the guidance picture.

A display system in a hydraulic shovel according to a fourth aspect of the present invention is the display system in the hydraulic shovel according to the third aspect, wherein information indicating the distance between a non-target surface excluding the target surface of the design surface and a position closest to the non-target surface among positions of the blade edge in the widthwise direction of the blade edge is displayed using a feature different from the information indicating the distance between the target surface and the position closest to the target surface when the non-target surface is closer to the blade edge of the bucket than the target surface.

A display system in a hydraulic shovel according to a fifth aspect of the present invention is the display system in the hydraulic shovel according to the third aspect, wherein information indicating the distance between an outer boundary of the target surface and a position closest to the outer boundary of the target surface among positions of the blade edge in the widthwise direction of the blade edge is displayed in the guidance picture, when the blade edge of the bucket is outside an area which is oriented perpendicular to the target surface.

A display system in a hydraulic shovel according to a sixth aspect of the present invention is the display system in the hydraulic shovel according to the fifth aspect, wherein information indicating whichever is the smaller of the distance between the outer boundary of the target surface and the position closest to the outer boundary of the target surface among positions of the blade edge in the widthwise direction of the blade edge and the distance between the target surface and the position closest to the target surface among positions of the blade edge in the widthwise direction of the blade edge is displayed in the guidance picture, when part of the blade edge of the bucket is outside an area which is oriented perpendicular to the target surface and another part of the blade edge of the bucket is within the area which is oriented perpendicular to the target surface.

A display system in a hydraulic shovel according to a seventh aspect of the present invention is the display system in the hydraulic shovel according to the third aspect, wherein information indicating the distance between an extended plane of the target surface and the position closest to the extended plane of the target surface among positions of the blade edge in the widthwise direction of the blade edge is displayed in the guidance picture, when the blade edge of the bucket is out of an area which is oriented perpendicular to the target surface.

A display system in a hydraulic shovel according to an eighth aspect of the present invention is the display system in the hydraulic shovel according to the first aspect, wherein the distance between the design surface and a position closest to the design surface in a direction parallel to a plane perpendicular to the widthwise direction being calculated as the distance between the design surface and the closest position.

A display system in a hydraulic shovel according to a ninth aspect of the present invention is the display system in the hydraulic shovel according to the first aspect, wherein the shortest distance between the design surface and the position closest to the design surface in any direction is calculated as the distance between the design surface and the closest position.

A display system in a hydraulic shovel according to a tenth aspect of the present invention is the display system in the hydraulic shovel according to the first aspect, wherein the image showing the positional relationship between the design surface and the blade edge of the bucket includes a line segment indicating a cross-section of the design surface as seen from the side, and an area closer to the ground than the tine segment and an area closer to the air than the line segment are shown in different colors.

A hydraulic shovel according to an eleventh aspect of the present invention is provided with the display system in the hydraulic shovel according to one of the first through the tenth aspects.

A method of controlling a display system in a hydraulic shovel according to a twelfth aspect of the present invention is a method of controlling a display system in a hydraulic shovel comprising a work machine including a bucket and a main body to which the work machine is attached. The control method comprises the following steps. In the first step, information pertaining to a current position of the hydraulic shovel is detected. In the second step, a position of the blade edge of the bucket is calculated on the basis of information pertaining to the current position of the hydraulic shovel. In the third step, the distance between a design surface indicating a target shape of a work object and a position closest to the design surface among positions of the blade edge in the widthwise direction of the blade edge is calculated on the basis of the positional information for the design surface and the position of the blade edge of the bucket. In the fourth step, a guidance picture including an image showing a positional relationship between the design surface and the blade edge of the bucket and information indicating the distance between the design surface and the closest position is displayed.

In the display system in the hydraulic shovel according to the first aspect of the present invention, information indicating the distance between the design surface and the position closest to the design surface among positions of the blade edge in the widthwise direction of the blade edge of the bucket is calculated. Thus, an operator is capable of easily ascertaining the distance from the design surface to the position of the blade edge of the bucket closest to the design surface even when the blade edge of the bucket is not oriented parallel to the design surface. This allows the operator to perform digging operation with precision.

In the display system in the hydraulic shovel according to the second aspect of the present invention, an operator can easily ascertain the position closest to the design surface in the head-on view of the bucket. This allows the operator to perform digging operation with greater precision.

In the display system in the hydraulic shovel according to the third aspect of the present invention, an operator is capable of performing digging operation with precision upon a selected target surface.

In the display system in the hydraulic shovel according to the fourth aspect of the present invention, it can easily be ascertained that a non-target surface adjacent to the target surface is closer to the blade edge of the bucket. This prevents the operator from mistakenly operating to dig an adjacent non-target surface, rather than the target surface.

In the display system in the hydraulic shovel according to the fifth aspect of the present invention, an operator can easily ascertain, when the blade edge of the bucket is out of an area which is oriented toward the target surface, how far the blade edge of the bucket is from the target surface.

In the display system in the hydraulic shovel according to the sixth aspect of the present invention, when part of the blade edge of the bucket is near the target surface, the distance between the blade edge of the bucket and the target surface is displayed even if another part of the blade edge of the bucket is out of an area which is oriented toward the target surface. This prevents an operator from mistakenly operating to overdig the target surface.

In the display system in the hydraulic shovel according to the seventh aspect of the present invention, a target surface can easily be shaped by operating the blade edge of the bucket so that the blade edge moves in a direction parallel to the target surface from a position away from the target surface (for example, the extended plane of the target surface). Accordingly, shaping after positioning the blade edge at the top of the slope prevents earth above the top of the slope from collapsing, or neat shaping from being impeded by the shock of the work machine when it begins to act.

In the display system in the hydraulic shovel according to the eighth aspect of the present invention, an operator can easily ascertain the distance between the design surface and the position closest to the design surface in a direction parallel to a plane perpendicular to the widthwise direction. Normally, when an operator operates the work machine, the bucket is moved in a plane perpendicular to the widthwise direction. Thus, having the abovementioned distance-indicating information displayed in the guidance picture enables the operator to precisely ascertain the distance between the blade edge of the bucket and the design surface when operating the work machine.

In the display system in the hydraulic shovel according to the ninth aspect of the present invention, an operator can easily ascertain the shortest distance between the design surface and the position closest to the design surface regardless of the direction to which the work machine is moved. For example, if the main body of the hydraulic shovel is tilted to the left or right, the bucket may move not only in the drive direction of the work machine, but also in the widthwise direction of the work machine. Additionally, if the main body is pivotable, the bucket moves in the widthwise direction when the main body pivots as welt. Thus, having the abovementioned distance-indicating information displayed in the guidance picture enables the operator to precisely ascertain the distance between the blade edge of the bucket and the design surface when moving the main body.

In the display system in the hydraulic shovel according to the tenth aspect of the present invention, an area closer to the ground than the line segment and an area closer to the air than the line segment are shown in different colors in the guidance picture. Thus, an operator can easily ascertain, when the blade edge of the bucket is moved far away from the design surface, that the bucket is positioned in an area where the design surface is not present.

In the hydraulic shovel according to the eleventh aspect of the present invention, information indicating the distance between the design surface and the position closest to the design surface among the positions of the blade edge in the widthwise direction of the blade edge of the bucket is calculated. Thus, an operator can easily ascertain the distance to the design surface from the position on the blade edge closest to the design surface even when the blade edge of the bucket is not oriented parallel to the design surface. This allows the operator to perform digging operation with precision.

In the method of controlling a display system in a hydraulic shovel according to the twelfth aspect of the present invention, information indicating the distance between the design surface and the position closest to the design surface among the positions of the blade edge of the bucket in the widthwise direction of the blade edge of the bucket is calculated. Thus, an operator can easily ascertain the distance to the design surface from the position on the blade edge closest to the design surface even when the blade edge of the bucket is not oriented parallel to the design surface. This allows the operator to perform digging operation with precision.

DETAILED DESCRIPTION OF EMBODIMENTS

1. Configuration

1-1. Overall Configuration of Hydraulic Shovel

Figure 1:
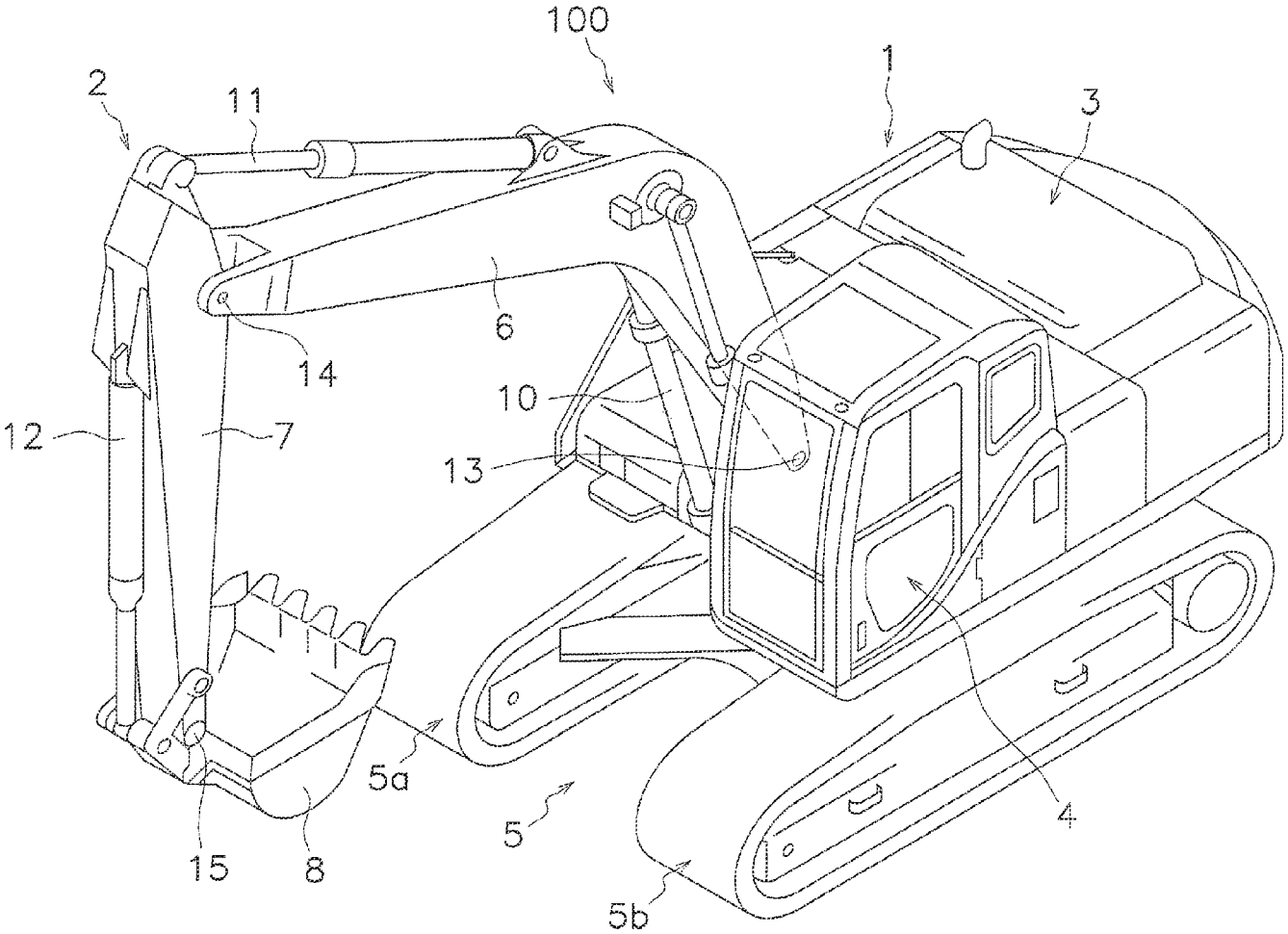
FIG. 1 is a perspective view of a hydraulic shovel.

There follows a description of a hydraulic shovel display system according to an embodiment of the present invention with reference to the drawings. FIG. 1 is a perspective view of a hydraulic shovel 100 in which a display system is installed. The hydraulic shovel 100 has a main vehicle body 1 and a work machine 2. The main vehicle body 1 is equivalent to the main body of the present invention. The main vehicle body 1 has an upper pivoting body 3, a cab 4, and a travel unit 5. The upper pivoting body 3 includes devices, such as an engine, a hydraulic pump, and/or the like, which are not shown in the drawings. The cab 4 is installed on the front of the upper pivoting body 3. A display input device 38 and an operating device 25 described below are disposed within the cab 4 (cf. FIG. 3). The travel unit 5 has tracks 5*a*, 5*b*, and the rotation of the tracks 5*a*, 5*b* causes the hydraulic shovel 100 to travel.

The work machine 2 is attached to the front of the main vehicle body 1, and has a boom 6, an arm 7, a bucket 8, a boom cylinder 10, an arm cylinder 11, and a bucket cylinder 12. The base end of the boom 6 is pivotally attached to the front of the main vehicle body 1 with a boom pin 13 disposed therebetween. The base end of the arm 7 is pivotally attached to the tip end of the boom 6 with an arm pin 14 disposed therebetween. The tip end of the arm 7 is pivotally attached to the bucket 8 with a bucket pin 15 disposed therebetween.

Figure 2:
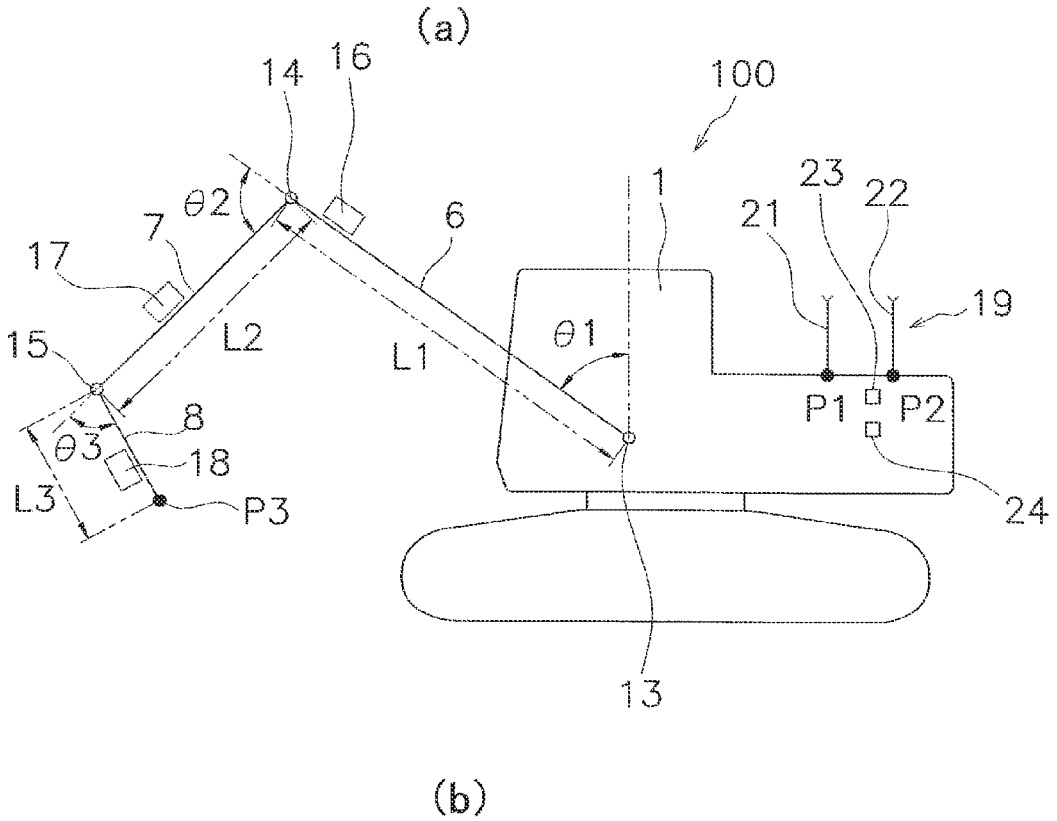
FIG. 2 is a schematic illustration of the configuration of the hydraulic shovel.
Figure 2:
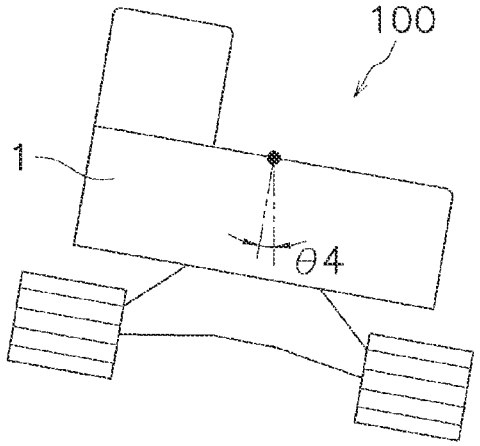

FIG. 2 is a schematic illustration of the configuration of the hydraulic shovel 100. FIG. 2(*a*) is a side view of the hydraulic shovel 100, and FIG. 2(*b*) is a rear view of the hydraulic shovel 100. As shown in FIG. 2(*a*), L1 is the length of the boom 6, i.e., the length from the boom pin 13 to the arm pin 14. L2 is the length of the arm 7, i.e., the length from the arm pin 14 to the bucket pin 115. L3 is the length of the bucket 8, i.e., the length from the bucket pin 15 to the blade edge of the bucket 8.

The boom cylinder 10, arm cylinder 11, and bucket cylinder 12 shown in FIG. 1 are hydraulic cylinders, each of which is driven by hydraulic pressure. The boom cylinder 10 drives the boom 6. The arm cylinder 11 drives the arm 7. The bucket cylinder 12 drives the bucket 8. A proportional control valve 37 (cf, FIG. 3) is disposed between a hydraulic pump not shown in the drawings and the hydraulic cylinders, such as the boom cylinder 10, arm cylinder 11, bucket cylinder 12, and the like. The proportional control valve 37 is controlled by a work machine controller 26 described below. Hence, the flow rate of hydraulic oil supplied to the hydraulic cylinders 10-12 is controlled. In this way, the movements of the hydraulic cylinders 10-12 are controlled.

As shown in FIG. 2(*a*), the boom 6, arm 7, and bucket 8 are provided with first through third stroke sensors 16-18, respectively. The first stroke sensor 16 detects the stroke length of the boom cylinder 10. A display controller 39 (cf. FIG. 3) calculates an angle of inclination θ1 of the boom 6 with respect to an axis Za (cf FIG. 7) of a main vehicle body coordinate system described below using the stroke length of the boom cylinder 10 detected by the first stroke sensor 16.

The second stroke sensor 17 detects the stroke length of the arm cylinder 11. The display controller 39 calculates an angle of inclination θ2 of the arm 7 with respect to the boom 6 using the stroke length of the arm cylinder 11 detected by the second stroke sensor 17. The third stroke sensor 18 detects the stroke length of the bucket cylinder 12. The display controller 39 calculates an angle of inclination θ3 of the bucket 8 with respect to the arm 7 using the stroke length of the bucket cylinder 12 detected by the third stroke sensor 18.

The main vehicle body 1 is provided with a position detector unit 19. The position detector unit 19 detects the current position of the hydraulic shovel 100. The position detector unit 19 has two Real-Time-Kinematic Global Navigation Satellite System (RTK-GNSS) antennas 21, 22 (hereafter, "GNSS antennas 21, 22"), a three-dimensional position sensor 23, and an inclination angle sensor 24. The GNSS antennas 21, 22 are disposed at a fixed interval along a Ya axis (cf. FIG. 7) of a main vehicle body coordinate system Xa-Ya-Za described below. Signals corresponding to GNSS radio waves received by the GNSS antennas 21, 22 are inputted to the three-dimensional position sensor 23. The three-dimensional position sensor 23 detects mounting positions P1, P2 of the GNSS antennas 21, 22. As shown in FIG. 2(*b*), the inclination angle sensor 24 detects an angle of inclination θ4 (hereafter, "roll angle θ4") of the widthwise direction of the main vehicle body 1 with respect to the direction of gravity (a vertical line). In the present embodiment, "widthwise direction" refers to the widthwise direction of the bucket 8, and is the same as the widthwise direction of the vehicle. However, if the work machine 2 is provided with a tilting bucket as described below, the widthwise direction of the bucket may not correspond to the vehicle widthwise direction.

Figure 3:
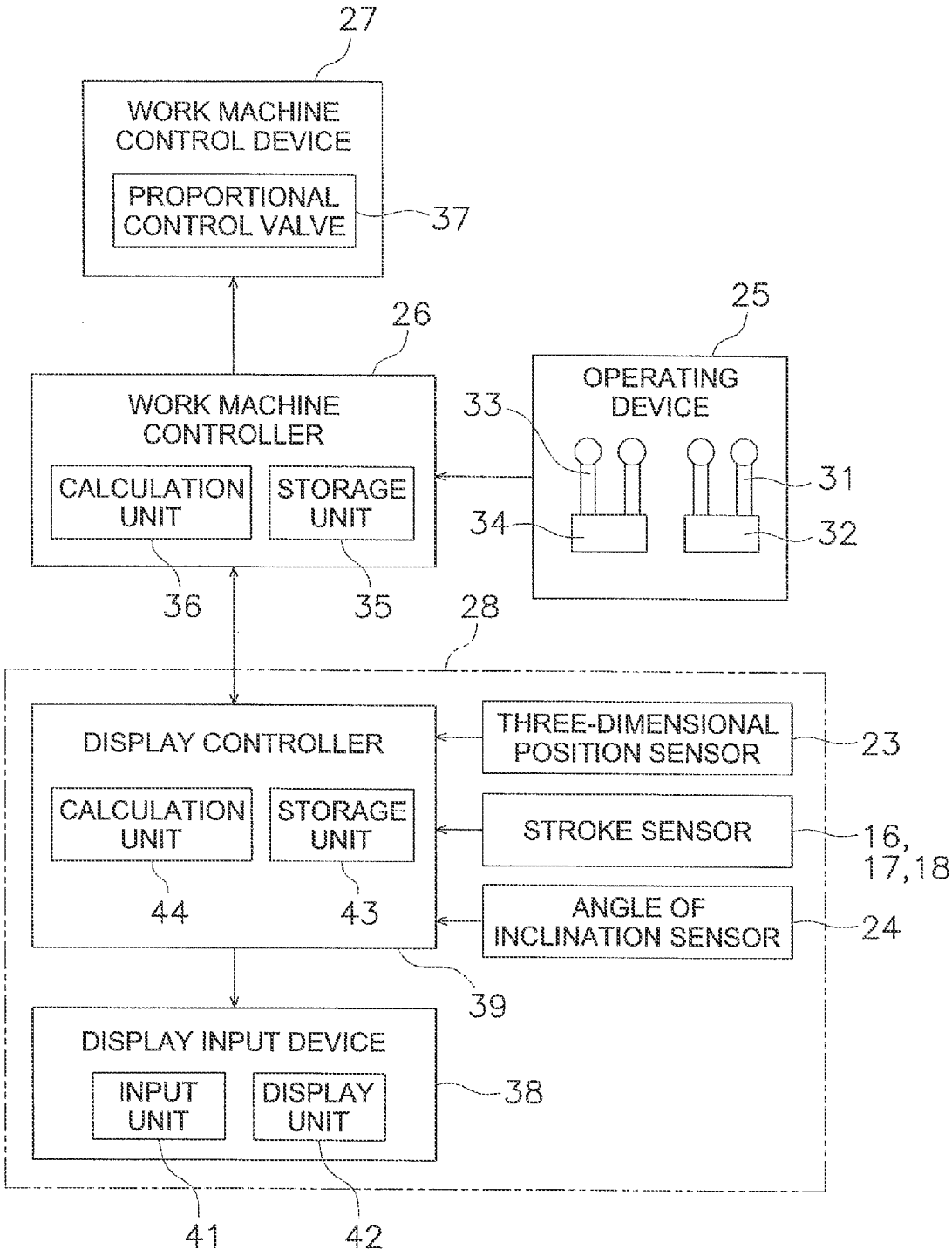
FIG. 3 is a block diagram showing the configuration of a control system which the hydraulic shovel comprises.

FIG. 3 is a block diagram of the configuration of a control system which the hydraulic shovel 100 comprises. The hydraulic shovel 100 comprises the operating device 25, the work machine controller 26, a work machine control device 27, and a display system 28. The operating device 25 has a work machine operating member 31, a work machine operation detector unit 32, a travel operating member 33, and a travel operation detector unit 34. The work machine operating member 31 is a member for allowing an operator to operate the work machine 2, and is, for example, an operating lever. The work machine operation detector unit 32 detects the details of the operation inputted by using the work machine operating member 31, and sends the details to the work machine controller 26 as a detection signal. The travel operating member 33 is a member for allowing an operator to operate the traveling of the hydraulic shovel 100, and is, for example, an operating lever. The travel operation detector unit 34 detects the details of the operation inputted by using the travel operating member 33, and sends the details to the work machine controller 26 as a detection signal.

The work machine controller 26 has a storage unit 35 such as RAM or ROM, and a calculation unit 36 such as a CPU. The work machine controller 26 primarily controls the work machine 2. The work machine controller 26 generates a control signal for causing the work machine 2 to act according to the operation of the work machine operating member 31, and outputs the signal to the work machine con rot device 27. The work machine control device 27 has the proportional control valve 37, and the proportional control valve 37 is controlled based on the control signal from the work machine controller 26. Hydraulic oil is drained from the proportional control valve 37 at a flow rate corresponding to the control signal from the work machine controller 26, and is supplied to the hydraulic cylinders 10-12. The hydraulic cylinders 10 to 12 are driven according to the hydraulic oil supplied from the proportional control valve 37. This causes the work machine 2 to act.

1-2. Configuration of Display System 28

The display system 28 is a system for providing an operator with information for digging the ground within a work area to form a shape like that of a design surface described hereafter. The display system 28 comprises a display input device 28 and a display controller 39 along with the first through third stroke sensors 16 to 18, the three-dimensional position sensor 23, and the inclination angle sensor 24 described above.

The display input device 38 has an input unit 41 like a touch panel, and a display unit 42 such as an LCD. The display input device 38 displays a guidance picture for providing information for digging operation. A variety of keys are shown in the guidance picture. An operator can execute the variety of functions of the display system 28 by touching the keys in the guidance picture. The guidance picture will be described in detail later.

Figure 4:
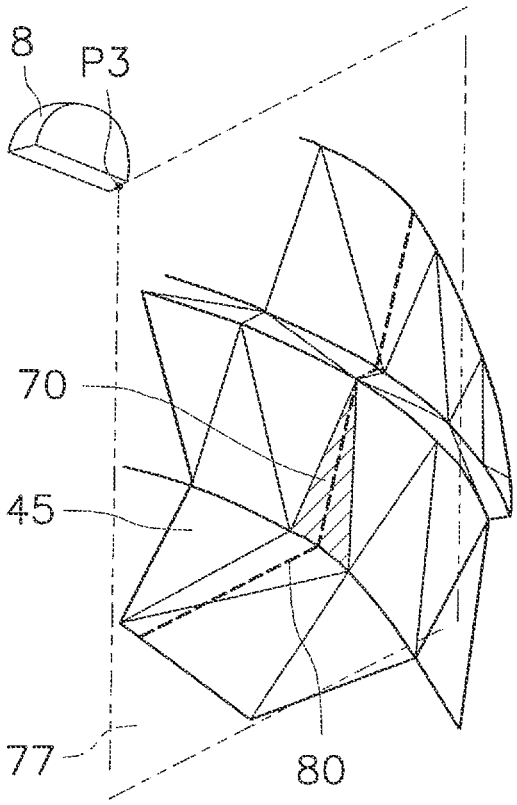
FIG. 4 is an illustration of a design land shape indicated by design land shape data.

The display controller 39 executes the variety of functions of the display system 28. The display controller 39 has a storage unit 43 such as RAM or ROM, and a calculation unit 44 such as a CPU. The storage unit 43 stores work machine data. The work machine data comprises the length L1 of the boom 6, the length L2 of the arm 7, and the length L3 of the bucket 8 described above. The work machine data also comprises the minimum and maximum values for each of the angle of inclination θ1 of the boom 6, the angle of inclination θ2 of the arm 7, and the angle of inclination θ3 of the bucket 8. The display controller 39 and the work machine controller 26 are capable of communicating with each other via wired or wireless communication means. Design land shape data is created in advance and stored in the storage unit 43 of the display controller 39. The design land shape data is information pertaining to the three-dimensional shape and position of the design land shape. The design land shape indicates a target shape for the ground that is the work object. The display controller 39 displays a guidance picture on the display input device 38 based on data such as the design land shape data and the results detected by the various sensors described above. Specifically, as shown in FIG. 4, the design land shape includes a plurality of design surfaces 45, each of which is represented using a triangular polygon. In FIG. 4, only one of the plurality of design surfaces is labeled 45, while labels for the other design surfaces are omitted. The target work object is one or a plurality of design surfaces among the design surfaces 45. The operator selects one or a plurality of design surfaces among the design surfaces 45 as a target surface 70. The display controller 39 causes the display input device 38 to display a guidance picture for informing the operator of the position of the target surface 70.

2. Guidance Picture

Figure 5:
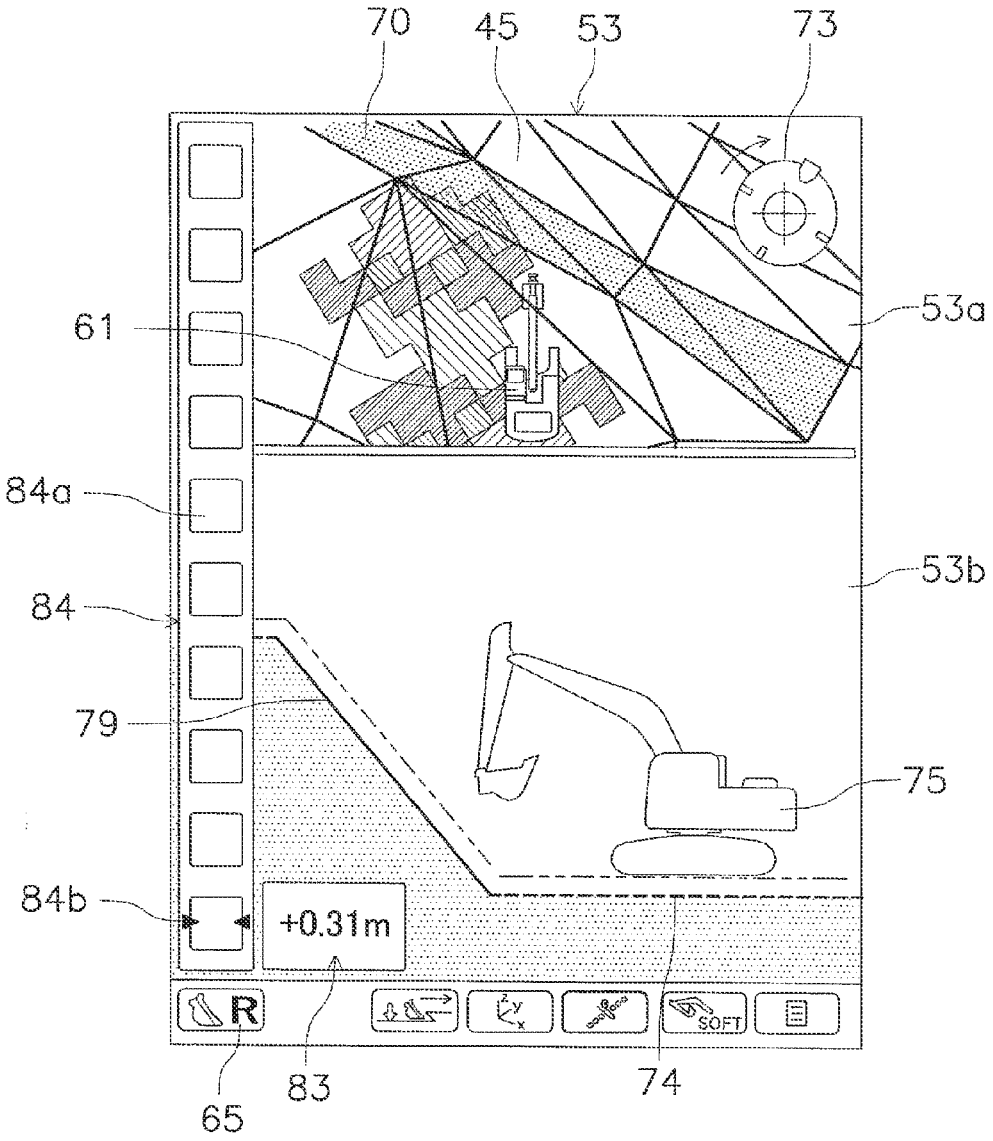
FIG. 5 is an illustration of a rough digging mode of a guidance picture.
Figure 6:
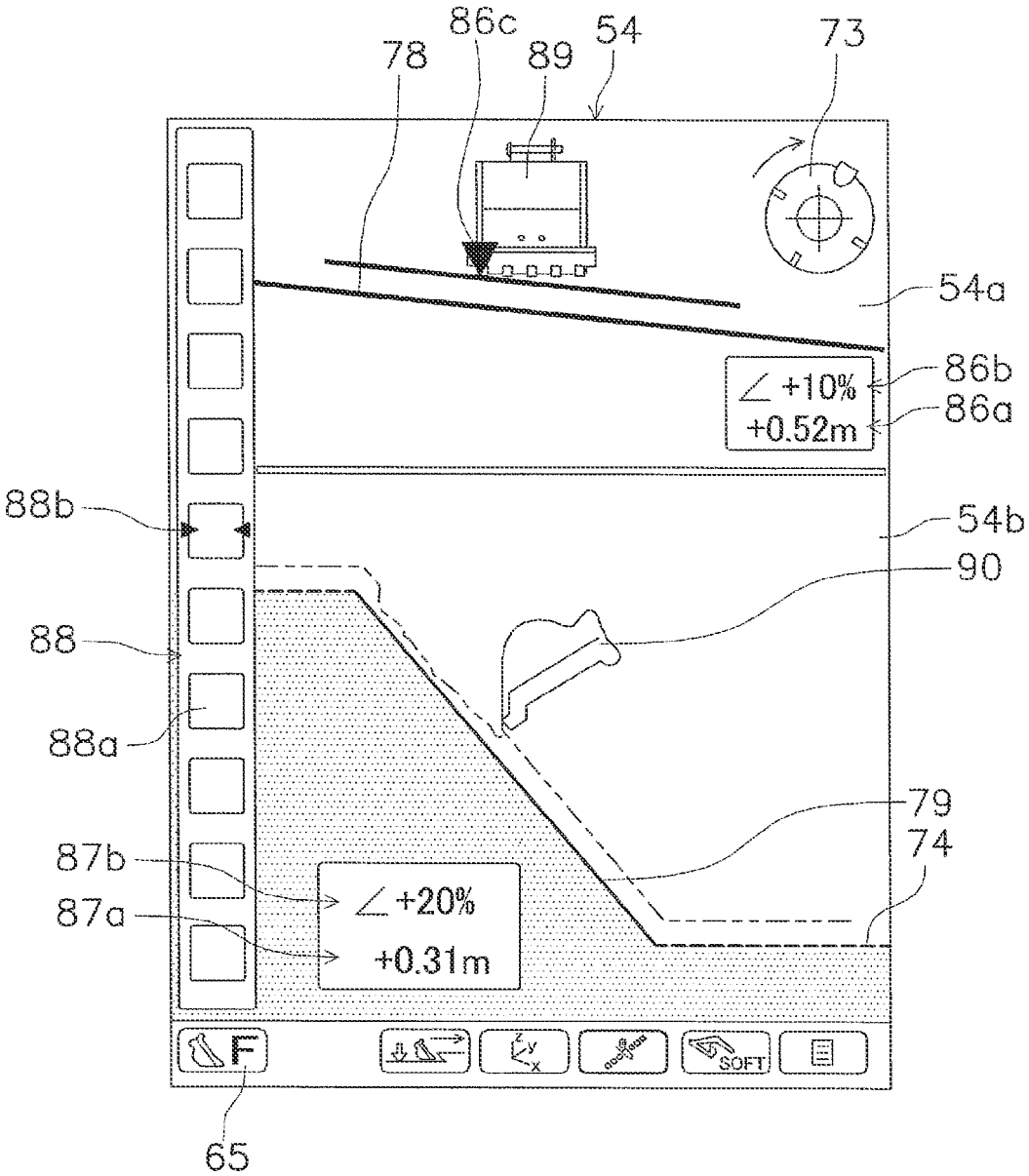
FIG. 6 is an illustration of a fine digging mode of a guidance picture.

There follows a detailed description of the guidance picture. The guidance picture is a picture for showing the positional relationship between the target surface 70 and the blade edge of the bucket 8, and for guiding the work machine 2 of the hydraulic shovel 100 so that the ground forming the work object takes on the same shape as the target surface 70. As shown in FIG. 5 and FIG. 6, the guidance picture includes a rough digging mode of a guidance picture (hereafter, "rough digging picture 53"), and a fine digging mode of a guidance picture (hereafter, "fine digging picture 54").

2-1. Rough Digging Picture 53

FIG. 5 illustrates the rough digging picture 53. The rough digging picture 53 comprises an upper view 53*a* showing the design land shape of the work area and the current position of the hydraulic shovel 100, and a side view 53*b* showing the positional relationship between the target surface 70 and the hydraulic shovel 100.

The upper view 53*a* of the rough digging picture 53 represents the design land shape as viewed from above using a plurality of triangular polygons. More specifically, the upper view 53*a* represents the design land shape using the pivoting plate of the hydraulic shovel 100 as a projected plane. Thus, the upper view 53*a* is a view directly from above the hydraulic shovel 100, and the design surface tilts when the hydraulic shovel 100 tilts. The target surface 70 selected from the plurality of design surfaces 45 as the target work object is displayed in a different color from the rest of the design surfaces 45. In FIG. 5, current position of the hydraulic shovel 100 is displayed as an icon 61 of the hydraulic shovel as seen from above, but another symbol may be displayed to indicate the current position. The upper view 53*a* comprises information for bringing the hydraulic shovel 100 directly face-to-face with the target surface 70. The information for bringing the hydraulic shovel 100 directly face-to-face with the target surface 70 is displayed as a facing compass 73, The facing compass 73 is an icon showing the direction directly facing the target surface 70 and the direction of the hydraulic shovel 100 to pivot in. The operator can find the degree to which the shovel faces the target surface 70 using the facing compass 73.

The side view 53*b* of the rough digging picture 53 comprises an image showing the positional relationship between the target surface 70 and the blade edge of the bucket 8, and distance information indicating the distance between the target surface 70 and the blade edge of the bucket 8. Specifically, the side view 53*b* comprises a design surface line 74, a target surface line 79, and an icon 75 of the hydraulic shovel 100 as seen from the side. The design surface line 74 indicates a cross section of the design surfaces 45 apart from the target surface 70. The target surface line 79 indicates a cross section of the target surface 70. As shown in FIG. 4, a design surface line 81 and a target surface line 8 are obtained by calculating an intersection 80 of the design surfaces 45 and a plane 77 passing through a current position of the blade edge P3 of the bucket 8. A method of calculating the current position of the blade edge P3 of the bucket 8 will be described later. In the side view 53*b*, the target surface line 79 is displayed in a different color from the design surface line 74. In FIG. 5, different types of line are used to represent the target surface line 79 and the design surface line 74. In the side view 53*b*, the area closer to the ground than the target surface line 79 and the design surface line 74 and the area on the side closer to the air than these line segments are displayed in different colors. In FIG. 5, a dot pattern in the area closer to the ground than the target surface line 79 and the design surface line 74 represents the difference in color.

The distance information indicating the distance between the target surface 70 and the blade edge of the bucket 8 comprises numerical value information 83 and graphic information 84. The numerical value information 83 is a numerical value indicating the shortest distance between the blade edge of the bucket 8 and the target surface 70. The graphic information 84 is information graphically indicating the distance between the blade edge of the bucket 8 and the target surface 70. Specifically, the graphic information 84 comprises index bars 84*a* and an index mark 84*b* indicating a position among positions of the index bars 84*a* where the distance between the blade edge of the bucket 8 and the target surface 70 is equivalent to zero. The index bars 84*a* are configured so as to illuminate according to the shortest distance between the tip of the bucket 8 and the target surface 70. Displaying the graphic information 84 may be switched on/off through the operator's operation. The method of calculating the distance between the blade edge of the bucket 8 and the target surface 70 will be described in detail later.

As described above, numerical values indicating the relative positional relationship between the target surface line 79 and the hydraulic shovel 100 and the shortest distance between the tip of the bucket 8 and the target surface line 79 are displayed in the rough digging picture 53. The operator can set the blade edge of the bucket 8 to move along the target surface line 79 so that the current land shape becomes the design land shape, which leads to easy operation of digging.

A picture change key 65 for switching between guidance pictures is displayed in the rough digging picture 53. An operator can switch from the rough digging picture 53 to the fine digging picture 54 by operating the screen change key 65.

2-2. Fine Digging Picture 54

FIG. 6 illustrates the fine digging picture 54. The fine digging picture 54 shows the positional relationship between the target surface 70 and the hydraulic shovel 100 in greater detail than the rough digging picture 53. Specifically, the fine digging picture 54 shows the positional relationship between the target surface 70 and the blade edge of the bucket 8 in greater detail than the rough digging picture 53. The fine digging picture 54 has a head-on view 54*a* showing the target surface 70 and the bucket 8, and a side view 54*b* showing the target surface 70 and the bucket 8. The head-on view 54*a* of the fine digging picture 54 comprises an icon 89 of the bucket 8 as seen head-on and a line 78 indicating a cross-section of the target surface 70 as seen head-on (hereafter, "target surface line 78"). The side view 54*b* of the fine digging picture 54 comprises an icon 90 of the bucket 8 as seen from the side and the design surface line 74. Both the head-on view 54*a* and the side view 54*b* of the fine digging picture 54 show information indicating the positional relationship between the target surface 70 and the bucket 8.

The information indicating the positional relationship between the target surface 70 and the bucket 8 on the head-on view 54*a* comprises distance information 86*a* and angle information 86*b*. The distance information 86*a* indicates the distance between the blade edge of the bucket 8 and the target surface 70 in the direction Za. As will be described later, this distance is the distance between the target surface 70 and the position closest to the target surface 70 among positions of the blade edge of the bucket 8 in the widthwise direction. In the head-on view 54*a*, a mark 86*c* indicating the closest position is displayed overlapping the icon 89 of the head-on view of the bucket 8. The angle information 86*b* is information indicating the angle between the target surface 70 and bucket 8. Specifically, the angle information 86*b* is the angle between an imaginary line segment passing through the blade edge of the bucket 8 and the target surface line 78.

The information indicating the positional relationship between the target surface 70 and the bucket 8 in the side view 54*b* comprises distance information 87*a* and angle information 87*b*. The distance information 87*a* indicates the shortest distance between the target surface 70 and the blade edge of the bucket 8, i.e., the distance between the target surface 70 and the tip of the bucket 8 in the direction of a line perpendicular to the target surface 70. The angle information 87*b* is information indicating the angle between the target surface 70 and the bucket 8. Specifically, the angle information 87*b* displayed in the side view 54*b* is the angle between the bottom surface of the bucket 8 and the target surface line 79.

The fine digging picture 54 includes graphic information 88 graphically indicating the distance between the blade edge of the bucket 8 and the target surface 70 as described above. The graphic information 88, like the graphic information 84 of the rough digging picture 53, has an index bar 88*a* and an index mark 88*b*.

As described above, the relative positional relationships between the target surface lines 78, 79 and the blade edge of the bucket 8 are shown in detail in the fine digging picture 54. The operator can set the blade edge of the bucket 8 to move along the target surface lines 78, 79 so that the current land shape takes on the same shape as the three-dimensional design land shape, which leads to easier operation of digging. As in the rough digging picture 53 as described above, a picture change key 65 is displayed in the fine digging picture 54. An operator can switch from the fine digging picture 54 to the rough digging picture 53 by operating the screen change key 65.

2-3. Method of Calculating Current Position of Blade Edge of Bucket 8

As described above, the target surface line 79 is calculated based on the current position of the blade edge of the bucket 8. The display controller 39 calculates the current position of the blade edge of the bucket 8 in a global coordinate system {X, Y, Z} based on the results detected by the three-dimensional position sensor 23, first through third stroke sensors 16-18, inclination sensor 24, and the like. Specifically, the current position of the blade edge of the bucket S is obtained as follows.

Figure 7:
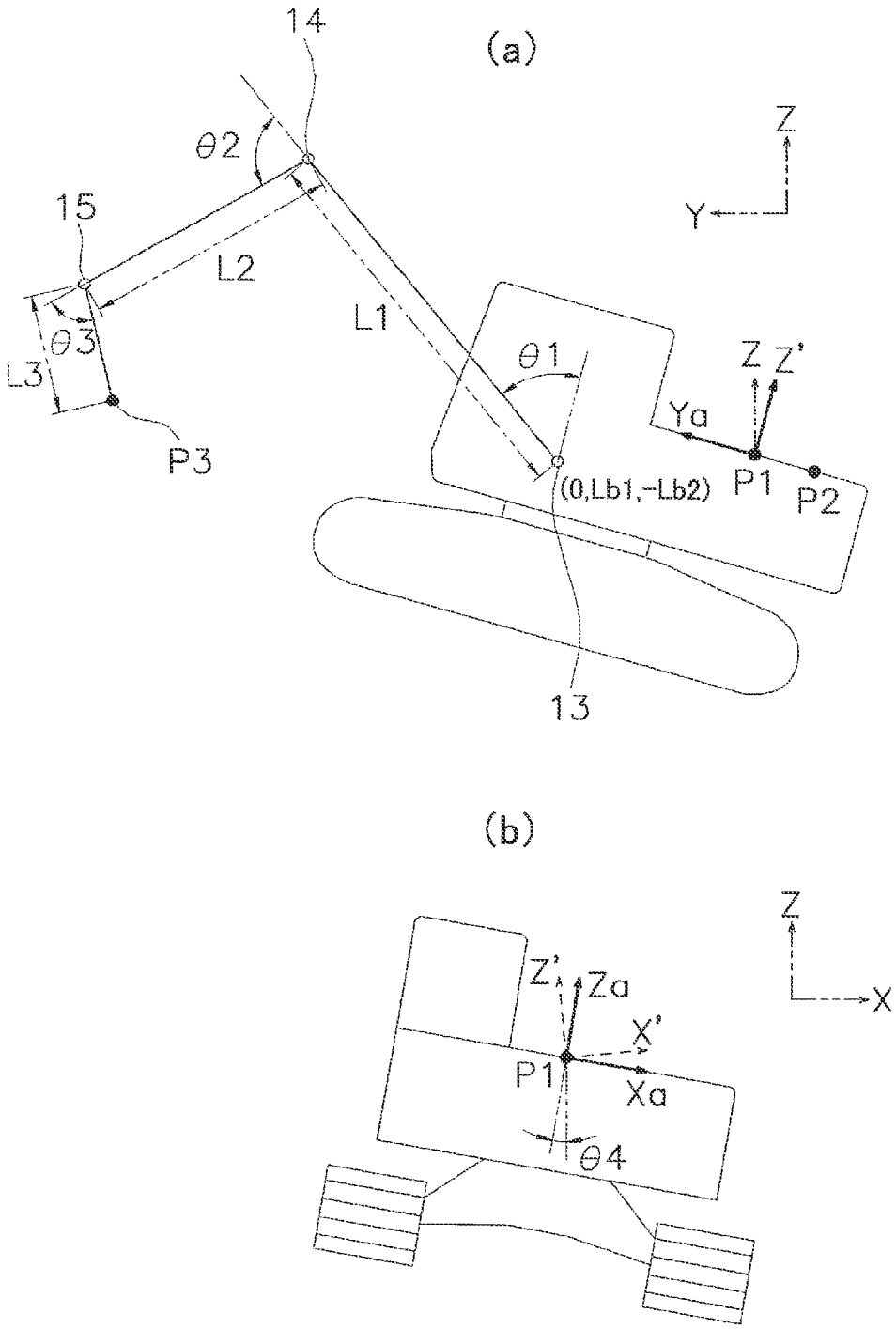
FIG. 7 shows a method of calculating the current position of a bucket blade edge.

First, as shown in FIG. 7, a main vehicle body coordinate system {Xa, Ya, Za} whose point of origin is the mounting position P1 of the GNSS antenna 21 described above is obtained. FIG. 7(*a*) is a side view of the hydraulic shovel 100. FIG. 7(*b*) is a rear view of the hydraulic shovel 100. Here, the front-back direction of the hydraulic shovel 100, i.e., the Ya axis direction of the main vehicle body coordinate system, is inclined with respect to the Y axis direction of the global coordinate system. The coordinates of the boom pin 13 in the main vehicle body coordinate system are (0, Lb1, −Lb2), and are stored in the storage unit 43 of the display controller 39 in advance.

The three-dimensional position sensor 23 detects the mounting positions P1, P2 of the GNSS antennas 21, 22. A unit vector for the Ya axis direction is calculated from the detected coordinate positions P1, P2 according to the following formula (1).

$$Ya=(P1-P2)/|P1-P2| \tag{1}$$

As shown in FIG. 7(*a*), introducing a vector Z' which is perpendicular to Ya and passes through the plane described by the two vectors Ya and Z, the following relationships are obtained.

$$(Z',Ya)=0 \tag{2}$$

$$Z'=(1-c)Z+cYa \tag{3}$$

In the above formula (3), c is a constant.

Based on formulas (2) and (3), Z' is Obtained in the following formula (4).

$$Z'=Z+\{(Ya-Z)/((Z,Ya)-1)\}(Ya-Z) \tag{4}$$

Furthermore, Define X' as a vector perpendicular to Ya and Z'. X' is obtained in the following formula (5).

$$X'=Ya\perp Z' \tag{5}$$

As shown in FIG. 7(*b*), the main vehicle body coordinate system is rotated around the Ya axis by the roll angle θ4, and is thus shown as in the following formula (6).

$$[\,Xa\quad Ya\quad Za\,]=[\,X'\quad Ya\quad Z'\,]\begin{bmatrix}\cos\theta 4 & 0 & \sin\theta 4\\ 0 & 1 & 0\\ -\sin\theta 4 & 0 & \cos\theta 4\end{bmatrix} \tag{6}$$

The current angles of inclination θ1, θ2, θ3 of the boom 6, arm 7, and bucket 8, respectively as described above are calculated from the results detected by the first through third stroke sensors 16-18. The coordinates (xat, yat, zat) of the blade edge P3 of the bucket 8 in the main vehicle body coordinate system are calculated according to the following formulas (7) through (9) using the angles of inclination θ1, θ2, θ3 and the boom 6, arm 7, and bucket 8 lengths L1, L2, L3, $$xat=0 \tag{7}$$

$$yat=Lb1+L1\sin\theta 1+L2\sin(\theta 1+\theta 2)+L3\sin(\theta 1+\theta 2+\theta 3) \tag{8}$$

$$zat=-Lb2+L1\cos\theta 1+L2\cos(\theta 1+\theta 2)+L3\cos(\theta 1+\theta 2+\theta 3) \tag{9}$$

The blade edge P3 of the bucket 8 moves along the plane Ya-Za in the main vehicle body coordinate system.

The coordinates of the blade edge P3 of the bucket 8 in the global coordinate system are obtained according to the following formula (10).

$$P3=xat\cdot Xa+yat\cdot Ya+zat\cdot Z+P1 \tag{10}$$

As shown in FIG. 4, the display controller 39 calculates, on the basis of the current position of the blade edge of the bucket 8 calculated as described above and the design land shape data stored in the storage unit 43, an intersection 80 of the three-dimensional design land shape and a Ya-Za plane 77 through which the blade edge P3 of the bucket 8 passes. The display controller 39 displays the part of the intersection passing through the target surface 70 in the guidance picture as the target surface line 79 described above.

2-4. Method of Calculating Distance Between Blade Edge of Bucket 8 and Target Surface 70

As described above, the distance between the blade edge of the bucket 8 and the target surface 70 displayed in the guidance picture is the distance between the target surface 70 and the position closest to the target surface 70 among positions of the blade edge in the widthwise direction of the blade edge. Processes executed by the display controller 39 in order to calculate the distance between the blade edge of the bucket 8 and the target surface 70 will be described with referring to FIG. 8.

First, in step S1, the current position of the hydraulic shovel 100 is detected. At this step, the display controller 39 detects the current position of the main vehicle body 1 based on the detection signal from the three-dimensional position sensor 23, as described above.

Figure 9:
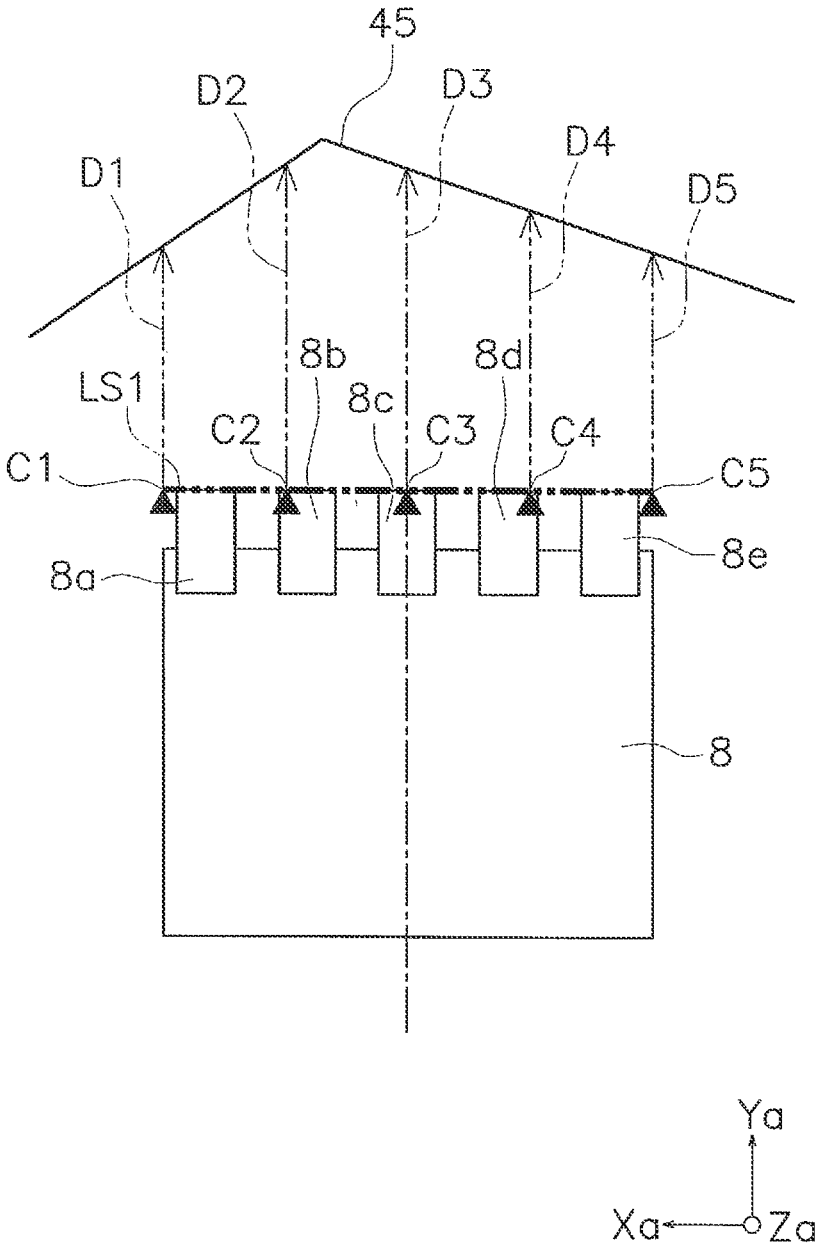
FIG. 9 is an illustration of reckoned points on the blade edge of the bucket.

In step S2, a plurality of reckoned points on the blade edge of the bucket 8 are set. As shown in FIG. 9, the bucket 8 has a plurality of blades 8*a*-8*e*. Therefore, an imaginary line segment LS1 which passes through the tips of the plurality of blades 8*a*-8*e* and which corresponds to the size of the bucket 8 in the widthwise direction of the bucket 8 is assumed, The imaginary line segment LS1 is divided into four sub-segments whose lengths are equal, and the five points indicating the ends of the sub-segments are set as first through fifth reckoned points C1 TO C5. Specifically, the first through fifth reckoned points C1 TO C5 indicate a plurality of positions of the blade edge of the bucket 8 in the widthwise direction of the blade edge. The current positions of the first through fifth reckoned points C1 TO C5 are then calculated based on the current position of the hydraulic shovel 100 calculated in step S1. Specifically, the current position of the central reckoned point C3 is calculated according to the method of calculating the current position of the blade edge of the bucket 8 described above. Then, the current positions of the other reckoned points C1, C2, C4, C5 are calculated from the current position of the central reckoned point C3 and the size of the bucket 8 in the widthwise direction of the bucket 8. The size of the bucket 8 in the widthwise direction of the bucket 8 is stored in advance as the work machine data described above.

Figure 8:
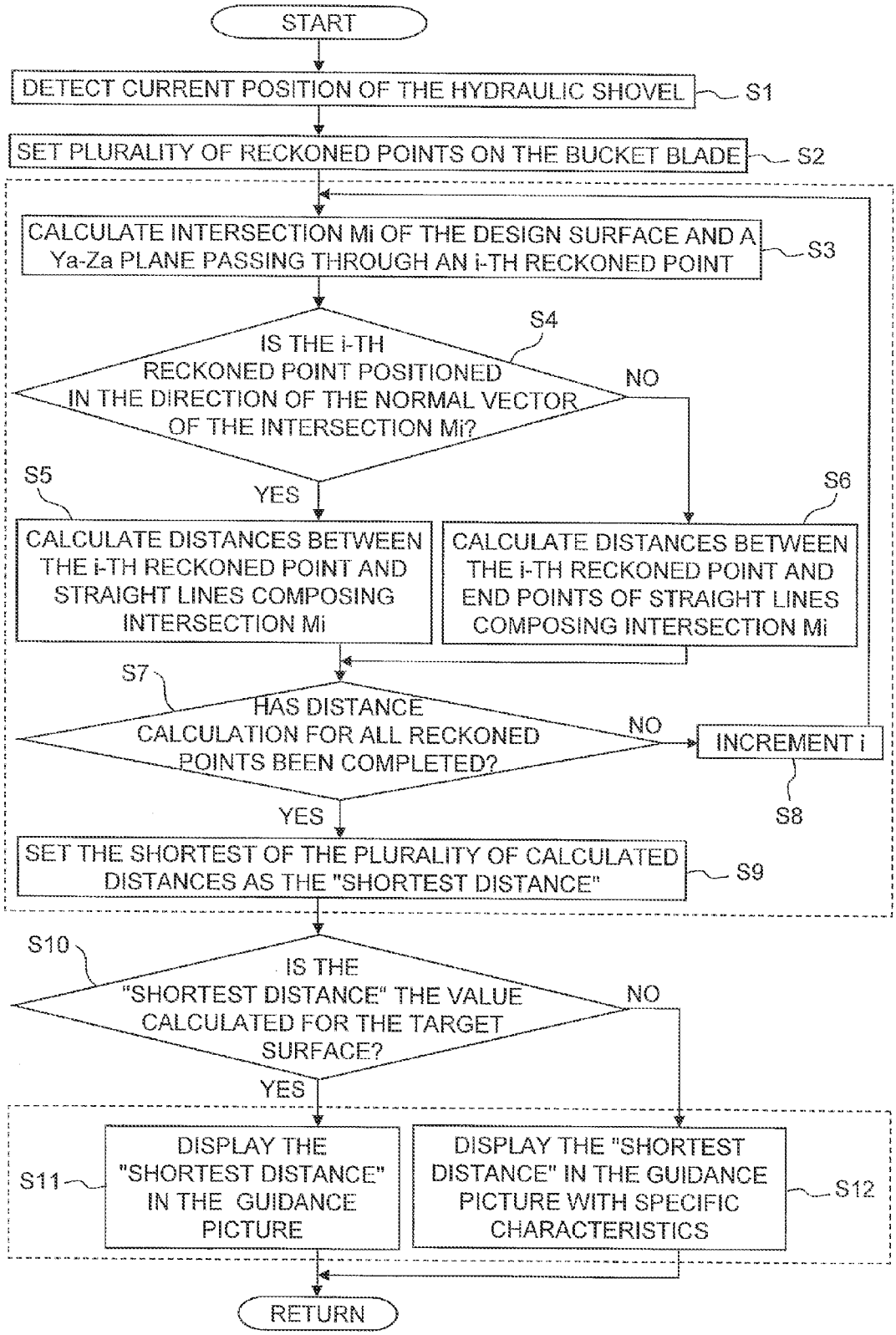
FIG. 8 is a flow chart of a method of calculating the distance between the blade edge of the bucket and a design surface.
Figure 10:
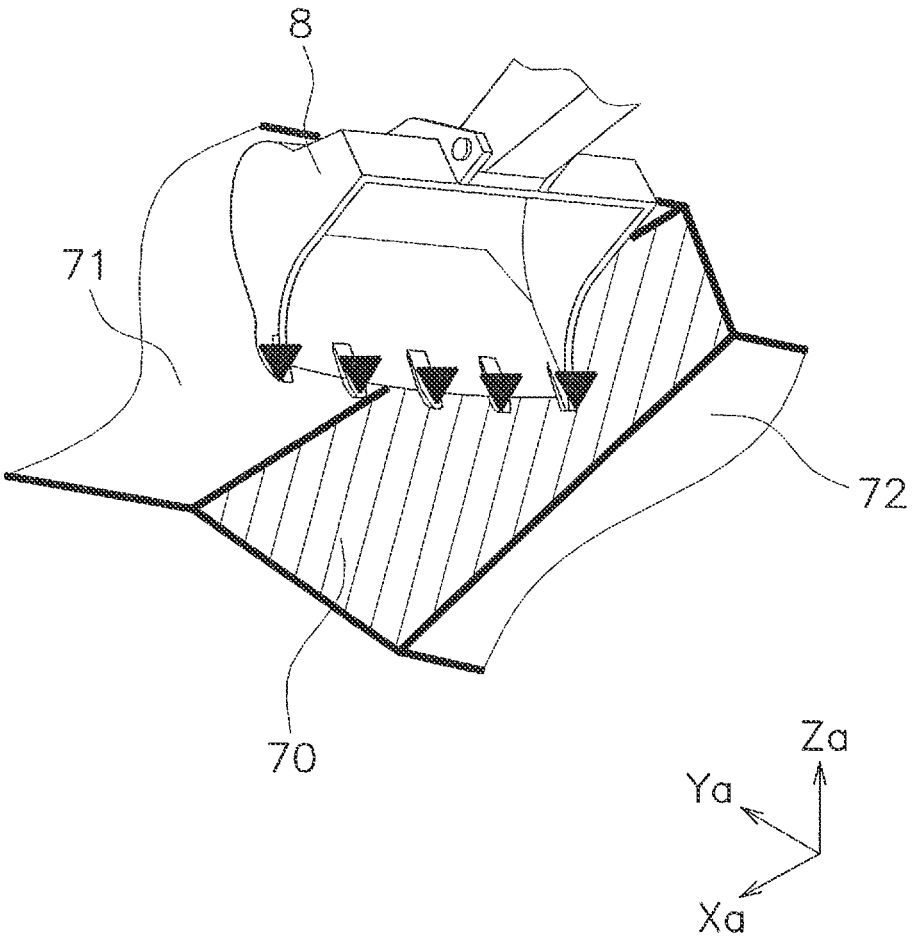
FIG. 10 is a perspective view of an example in which the blade edge of the bucket is positioned over both a target surface and a non-target surface.
Figure 11:
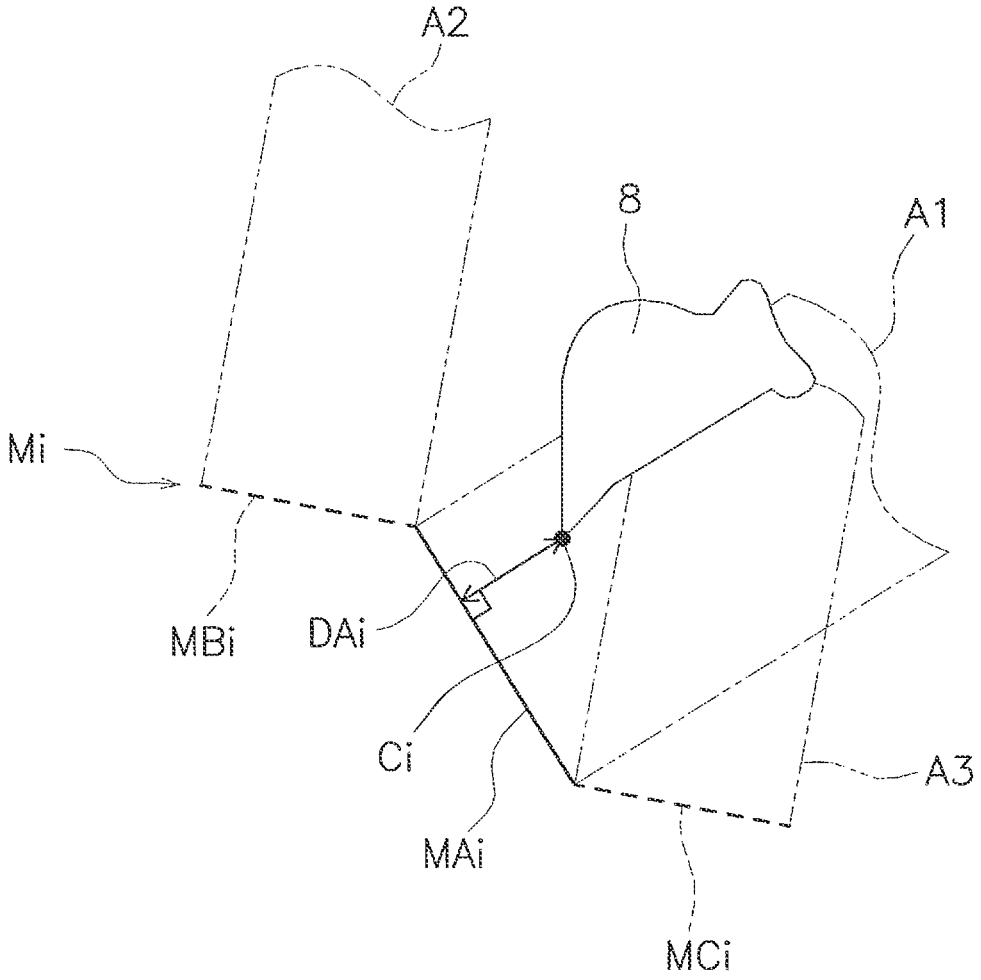
FIG. 11 is a side view of a reckoned point positioned within the target area.

Next, in steps S3 through S9, the distance between the design surface 45 and the reckoned point closest to the design surface 45 among the first through fifth reckoned points C1 TO C5 is calculated based on the positional information for the design surface 45 and the current positions of the first through fifth reckoned points C1 TO C5. The specific processes are followings:

In step S3, an intersection Mi of the design surface 45 and a Ya-Za plane passing through an i-th reckoned point Ci is calculated, where i is a variable, and the value of i for the i-th reckoned point Ci is set to 1 at the beginning of the flow shown in FIG. 8. At this step, the intersection Mi of the design surface 45 and the Ya-Za plane passing through the i-th reckoned point Ci is calculated according to a method similar to the method of obtaining the intersection 80 as described above, which is shown in FIG. 4. For example, let us assume that the blade edge of the bucket 8 is disposed over both a target surface 70 selected from the design surfaces 45 by an operator and unselected non-target surfaces 71, 72, as shown in FIG. 10. The non-target surfaces 71, 72 include a first non-target surface 71 and a second non-target surface 72, and the target surface 70 is positioned between the first non-target surface 71 and the second non-target surface 72. Here, as shown in FIG. 11, the intersection Mi of the design surface and the Ya-Za plane passing through the i-th reckoned point Ci comprises a target line MAi, a first non-target line MBi, and a second non-target line MCi. The target line MAi is the intersection of the target surface and the Ya-Za plane passing through the i-th reckoned point Ci, and is a straight line indicating the cross-section of the target surface 70. The first non-target line MBi is the intersection of the first non-target surface 71 and the Ya-Za plane passing through the i-th reckoned point Ci, and is a straight line indicating the cross-section of the first non-target surface 71. The second non-target line MCi is the intersection of the second non-target surface 72 and the Ya-Za plane passing through the i-th reckoned point Ci, and is a straight line indicating the cross-section of the second non-target surface 72.

Figure 12:
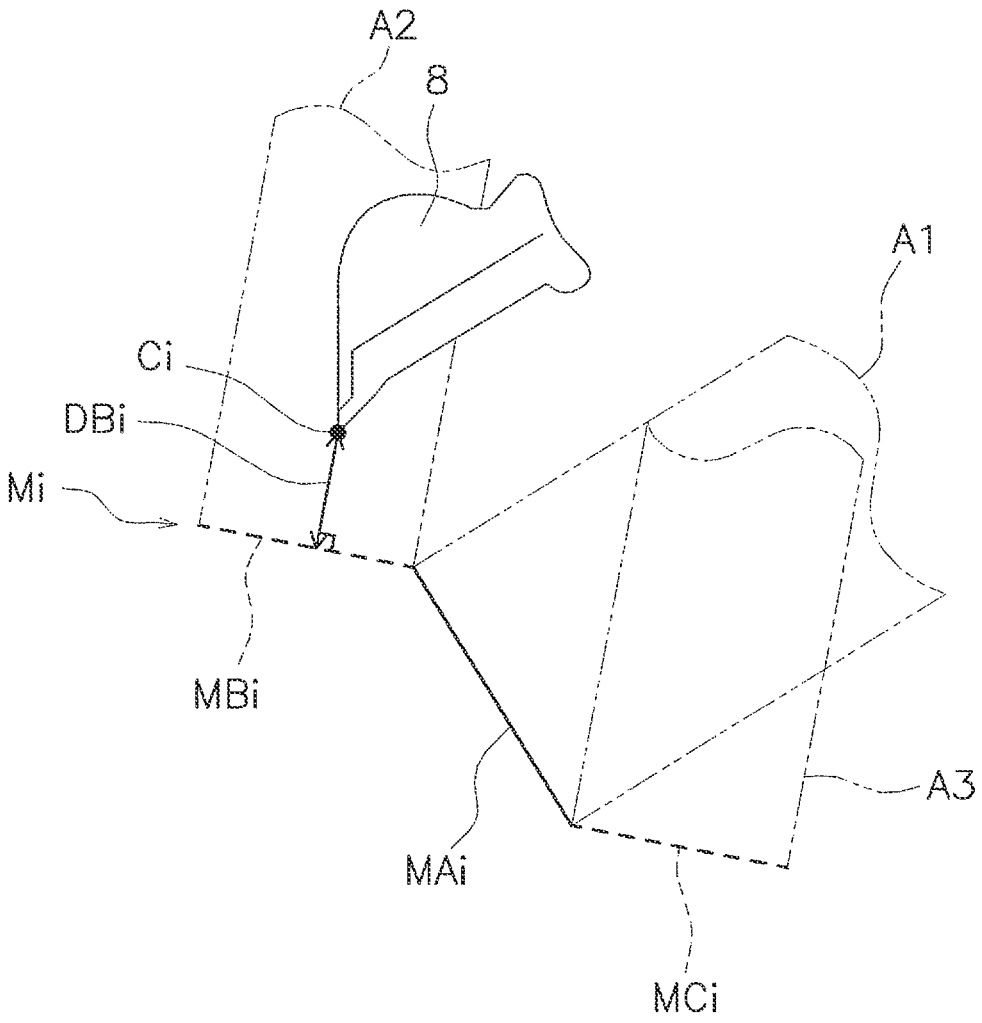
FIG. 12 is a side view of a reckoned point positioned within a first non-target area.
Figure 13:
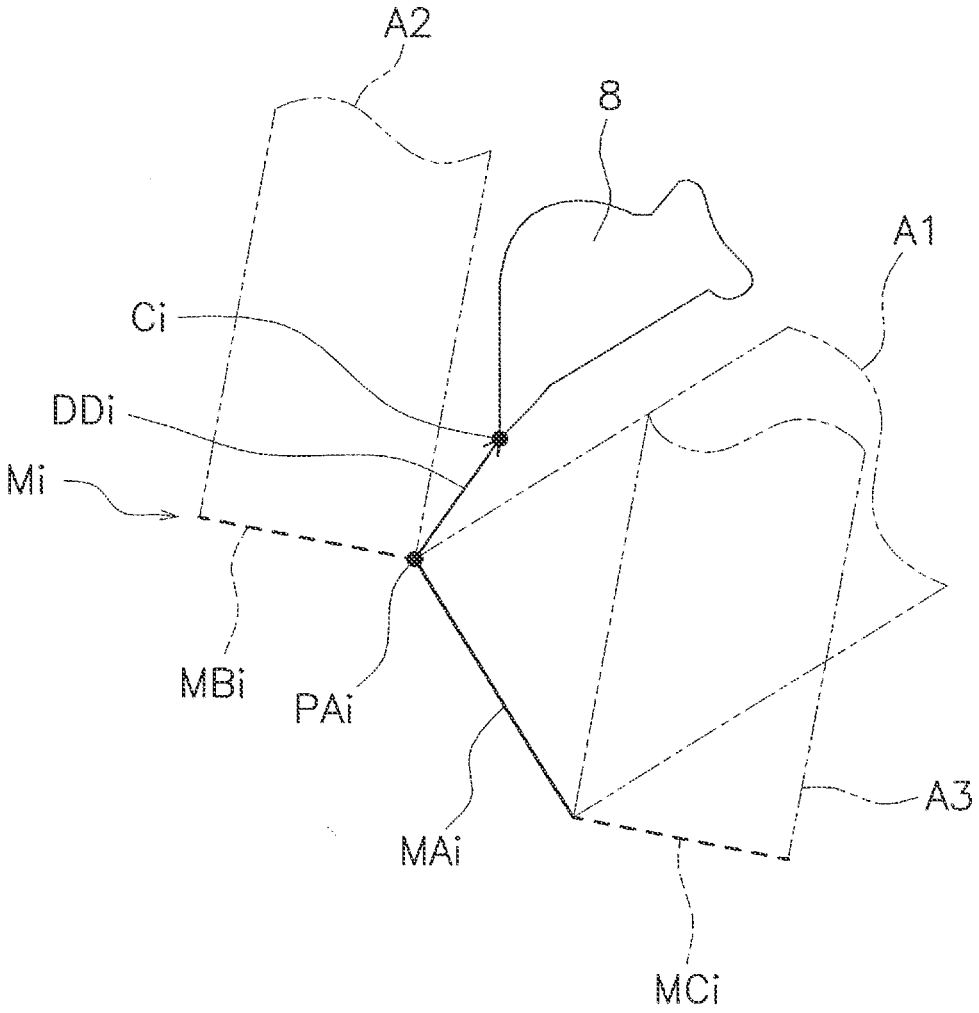
FIG. 13 is a side view of a reckoned point positioned in a gap area between a target area and a first non-target area.

Its step S4, it is determined whether or not the i-th reckoned point Ci of the blade edge of the bucket 8 is positioned in the direction of a line perpendicular to the intersection Mi. For example, if the i-th reckoned point Ci is positioned in an area perpendicularly facing the target line MAi (hereafter, "target area A1"), as shown in FIG. 11, the i-th reckoned point Ci is determined to be positioned in the direction of a line perpendicular to the intersection Mi. If the i-th reckoned point Ci is positioned in an area perpendicularly facing the first nor target line MBi (hereafter, "first non-target area A2"), as shown in FIG. 12, the i-th reckoned point Ci of the blade edge of the bucket 8 is also determined to be positioned in the direction of a line perpendicular to the intersection Mi. However, if the i-th reckoned point Ci is positioned in a gap area between the target area A1 and the first non-target area A2, as shown in FIG. 13, the i-th reckoned point Ci of the blade edge of the bucket 8 is determined not to be positioned in the direction of a line perpendicular to the intersection Mi.

Figure 14:
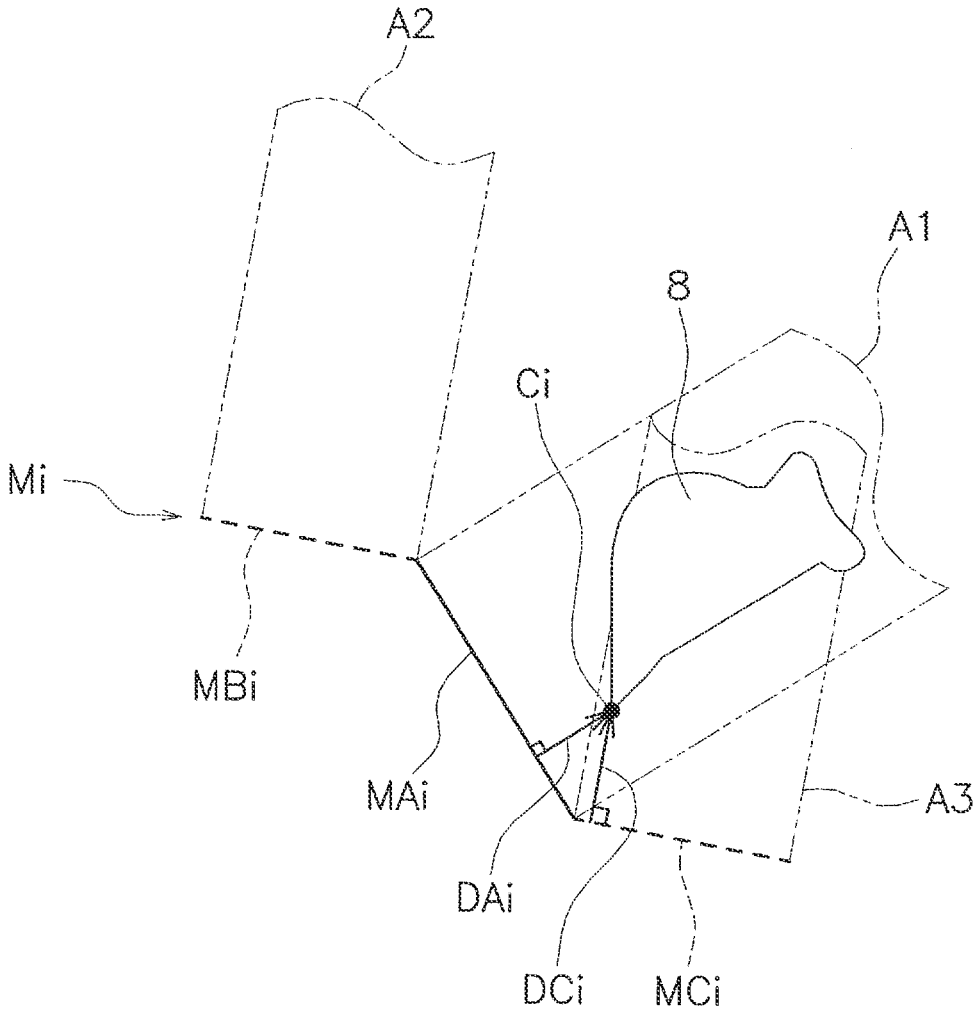
FIG. 14 is a side view of a reckoned point positioned within an area in which a target area and a second non-target area overlap.
Figure 15:
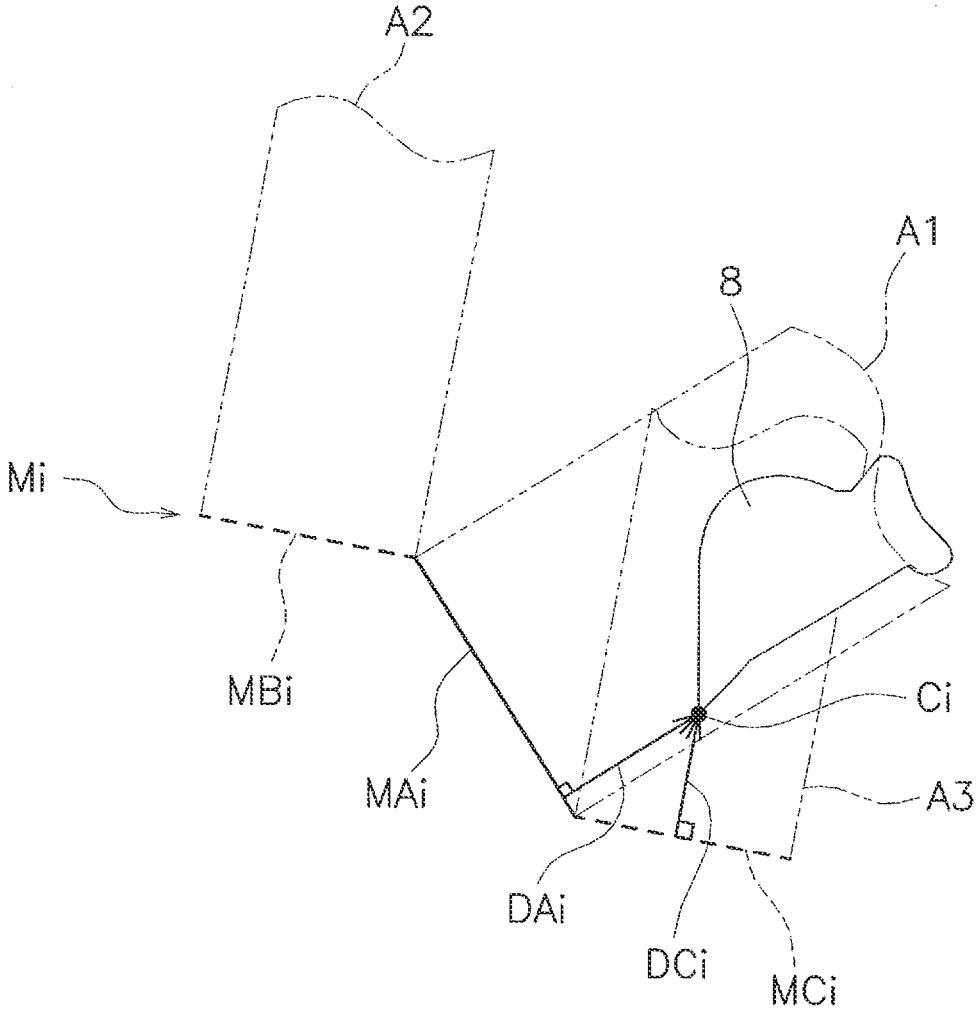
FIG. 15 is a side view of a reckoned point positioned within an area in which a target area and a second non-target area overlap.

If the i-th reckoned point Ci of the blade edge of the bucket 8 is determined to be positioned in the direction of a line perpendicular to the intersection Mi in step S4, step S5 is subsequently processed. In step S5, the distances between the i-th reckoned point Ci and the straight lines MAi-MCi composing the intersection Mi are calculated. In this step, lines passing through the i-th reckoned point Ci which are perpendicular to the straight lines MAi-MCi composing the intersection Mi are calculated, and the distances between the straight lines MAi-MCi and the i-th reckoned point Ci are calculated. For example, if the i-th reckoned point Ci is positioned within the target area A1 as shown in FIG. 11, a tine passing through the i-th reckoned point Ci which is perpendicular to the target line MAi is calculated, and the shortest distance between the i-th reckoned point Ci and the target line MAi (hereafter, "target surface distance DAi") is calculated. If the i-th reckoned point Ci is positioned within the first non-target area A2, as shown in FIG. 12, a line passing through the i-th reckoned point Ci which is perpendicular to the first non-target line MBi is calculated, and the shortest distance between the i-th reckoned point Ci and the first non-target line MBi (hereafter, "first non-target surface distance DAi") is calculated. However, if the i-th reckoned point Ci is positioned within an area in which the target area A1 overlaps with the area perpendicularly facing the second non-target line MCi (hereafter, "second non-target area A3"), as shown in FIG. 14 and FIG. 15, two perpendicular lines are calculated. Specifically, a line passing through the i-th reckoned point Ci which is perpendicular to the target line MAi and a line passing through the i-th reckoned point Ci which is perpendicular to the second non-target line MCi are calculated. The target surface distance DAi at the i-th reckoned point Ci and the shortest distance between the i-th reckoned point Ci and the second non-target line MCi (hereafter, "second non-target surface distance DCi") are calculated.

If the i-th reckoned point Ci of the blade edge of the bucket 8 is determined not to be in the direction of a line perpendicular to the design surface 45 in step S4, step S6 is subsequently processed. In step S6, a distance between an i-th reckoned point Ci of the blade edge of the bucket 8 and each of end points of the straight lines MAi-MCi is calculated for each of the straight lines MAi-MCi of the intersection Mi. For example, a distance between the i-th reckoned point Ci and an end point PAi of the target line MAi (hereafter, "provisional target surface distance DDi") is calculated, as shown in FIG. 13.

In step S7, it is determined whether or not distance calculation for all the reckoned points C1 to C5 has been completed. In the present embodiment, five reckoned points C1 to C5 are set. Thus, it is determined whether or not the distance calculation of steps S3-S6 for the first through fifth reckoned points C1 TO C5 has been completed. If distance calculation for all of the reckoned points has not been completed, the i value of the i-th reckoned point Ci is incremented by 1 in step S8, and the flow returns to step S3. The processes from step S3 through step S6 are then repeated, and step S9 is subsequently processed once distance calculation for all the reckoned points C1 to C5 has been completed.

In step S9, the shortest of the plurality of calculated distances is set as the "shortest distance". Thus, the reckoned point closest to the design surface 45 among the plurality of reckoned points C1 to C5 on the blade edge of the bucket 8 is determined to be the closest position. The distance between the design surfaces 45 and the reckoned point corresponding to the closest position is set as the "shortest distance".

In step S10, it is determined whether or not the "shortest distance" is the value calculated for the target surface 70. Specifically, it is determined whether or not the distance set as the "shortest distance" is that calculated for the target line MAi including the end point PAi. If the "shortest distance" is the value calculated for the target surface 70, step S11 is subsequently processed. If the "shortest distance" is determined not to be the value calculated for the target surface 70, step S12 is subsequently processed.

In step S11 and step S12, the "shortest distance" is displayed in the guidance picture. Specifically, in step S11, information indicating the "shortest distance" selected in step S9 is displayed in the rough digging picture 53 and the fine digging picture 54 along with an image showing the positional relationship between the design surfaces 45 and the blade edge of the bucket 8. Additionally, as described above, the mark 86*c* indicating the position of the reckoned point corresponding to the closest position is displayed overlapping with the head-on view 54*a* in the fine digging picture 54. The appearance of the display of the information indicating the "shortest distance" in step S11 will be referred to hereafter as the "normal display appearance." Specifically, if the "shortest distance" is determined to be the value calculated for the target surface 70 in step S10, the "shortest distance" is displayed in the guidance picture with the normal display appearance.

In step S12, the "shortest distance" is displayed in the guidance picture with specific characteristics. In this step, the information indicating the "shortest distance" is displayed with characteristics different from the normal display appearance in the rough digging picture 53 and the fine digging picture 54. For example, the visual elements of the text or graphics for the information indicating the "shortest distance," such as color or size, are different from the normal display appearance. Specifically, when the "shortest distance" is the value calculated for the first non-target surface 71 or the second non-target surface 72, the "shortest distance" is displayed in the guidance picture with specific characteristics.

As described above, the "shortest distance" is calculated and displayed in the guidance picture. A specific example of the calculation of the shortest distance will be shown below.

If all of the first through fifth reckoned points C1 TO C5 are positioned within the target area A1, as shown in FIG. 11, the target surface distance DAi is calculated for each of the first through fifth reckoned points C1 TO C5. The shortest of the five target surface distances DAi is selected as the "shortest distance". Specifically, the target surface distance DAi for the reckoned point closest to the target surface 70 is set as the "shortest distance". The "shortest distance" is then displayed in the guidance picture with the normal display appearance.

If all of the first through fifth reckoned points C1 TO C5 are positioned in the first non-target area A2, as shown in FIG. 12, the first non-target surface distance DBi is calculated for each of the first through fifth reckoned points C1 TO C5. The shortest of the five first non-target surface distances DBi is selected as the "shortest distance". Specifically, the first non-target surface distance DBi for the reckoned point closest to the first non-target surface 71 among the first through fifth reckoned points C1 TO C5 is set as the "shortest distance". The "shortest distance" is then displayed in the guidance picture with specific characteristics.

If all of the first through fifth reckoned points C1 TO C5 are positioned in the gap area between the target area A1 and the first non-target area A2, as shown in FIG. 13, the provisional target surface distance DDi is calculated for each of the first through fifth reckoned points C1 TO C5. The shortest of the five provisional target surface distances DDi is selected as the "shortest distance". Specifically, the provisional target surface distance DDi for the reckoned point closest to the outer boundary of the target surface 70 among the first through fifth reckoned points C1 TO C5 is set as the "shortest distance". The "shortest distance" is then displayed in the guidance picture with the normal display appearance.

If some of the first through fifth reckoned points C1 TO C5 are positioned within the target area A1, as shown in FIG. 11, and the other of the first through fifth reckoned points C1 TO C5 are positioned within the gap area between the target area A1 and the first non-target area A2, as shown in FIG. 13, then the shortest of target surface distance DAi and provisional target surface distance DDi for the first through fifth reckoned points C1 TO C5 is selected as the "shortest distance". The "shortest distance" is then displayed in the guidance picture with the normal display appearance.

If all of the first through fifth reckoned points C1 TO C5 are positioned in an area in which the target area A1 overlaps with the second non-target area A3, as shown in FIG. 14 and FIG. 15, the shortest of target surface distance DAi and second non-target surface distance DCi for the first through fifth reckoned points C1 TO C5 is set as the "shortest distance". Thus, when the second non-target surface 72 is closer to the blade edge of the bucket 8 than the target surface 70, the second non-target surface distance DCi fir the reckoned point positioned closest to the second non-target surface 72 is displayed in the guidance picture with specific characteristics. When the target surface 70 is closer to the blade edge of the bucket 8 than the second non-target surface 72, the target surface distance DAi for the reckoned point positioned closest to the target surface 70 is displayed in the guidance picture with the normal display appearance.

In addition, a case is assumed in which the first through fifth reckoned points C1 TO C5 are positioned in the areas shown in FIG. 11 through HG 15. Specifically, the first reckoned point C1 is positioned in the first non-target area A2 shown in FIG. 12. The second reckoned point C2 is positioned in the gap area shown in FIG. 13. The third reckoned point C3 is positioned in the target area A1 shown in FIG. 11. The fourth reckoned point C4 is positioned in the area in which the target area A1 overlaps with the second non-target area A3 as shown in FIG. 14. The fifth reckoned point C5 is positioned in the area in which the target area A1 overlaps with the second non-target area A3 as shown in FIG. 15. In this case, the first non-target surface distance DBi shown in FIG. 12 is calculated for the first reckoned point C1. The provisional target surface distance DDi shown in FIG. 13 is calculated for the second reckoned point C2. The target surface distance DAi shown in FIG. 11 is calculated for the third reckoned point C3. The target surface distance DAi shown in FIG. 14 is calculated for the fourth reckoned point C4. The second non-target surface distance DCi shown in FIG. 15 is calculated for the fifth reckoned point C5. The shortest of the first non-target surface distance DBi for the first reckoned point C1, the provisional target surface distance DDi for the second reckoned point C2, the target surface distance DAi for the third reckoned point C3, the target surface distance DAi for the fourth reckoned point C4, and the second non-target surface distance DCi for the fifth reckoned point C5 is then selected as the "shortest distance". When one of the provisional target surface distance DDi for the second reckoned point C2, the target surface distance DAi for the third reckoned point C3, or the target surface distance DAi for the fourth reckoned point C4 is selected as the "shortest distance", the information indicating the "shortest distance" is shown in the guidance picture with the normal display appearance. When one of the first non-target surface distance DBi for the first reckoned point C1 or the second non-target surface distance DCi for the fifth reckoned point C5 is selected as the "shortest distance", the information indicating the "shortest distance" is displayed in the guidance picture with specific characteristics.

3. Characteristics

The hydraulic shovel display system 28 according to the present embodiment has the following characteristics.

The display controller 39 calculates the distance between the design surface 45 and the position closest to the design surface 45 among the first reckoned point C1 through the fifth reckoned point C5 on the blade edge of the bucket 8 as the "shortest distance", and displays distance information indicating the "shortest distance" in the guidance picture. Thus, even when the blade edge of the bucket 8 is not positioned parallel to the design surface 45, as shown in FIG. 9, an operator can easily ascertain the distance from the closest position on the blade edge of the bucket 8 to the design surfaces 45. This allows the operator to perform precise digging operation.

As shown in FIG. 6, the mark 86*c* indicating the position closest to the design surfaces 45 is shown in the head-on view of the bucket 8 composing the fine digging picture 54. Thus, an operator can easily ascertain the position closest to the design surface 45 in the head-on view of the bucket 8. This allows the operator to perform more precise digging operation.

When the distance from the closest position to the non-target surface is calculated as the shortest distance, information indicating the shortest distance is displayed with characteristics different from the normal display appearance. Thus, an operator can easily ascertain that the non-target surface adjacent to the target surface 70 is closer to the blade edge of the bucket 8 than the target surface 70. This prevents the operator from mistakenly operating to dig an adjacent non-target surface, rather than the target surface 70.

When the blade edge of the bucket 8 is positioned in a gap area out of the target area A1, as shown in FIG. 13, the distance from the outer boundary of the target surface 70 is calculated. Accordingly, an operator can easily ascertain, when the blade edge of the bucket 8 is out of an area in which the blade edge faces the target surface 70, how far the blade edge of the bucket 8 is from the target surface 70.

When some of the reckoned points are positioned within the target area A1, and the other reckoned points are positioned in a gap area out of the target area A1, the shortest of the distances from the reckoned points is selected as the shortest distance. Thus, even if some part of the blade edge of the bucket 8 is out of the target area A1, the distance between the blade edge of the bucket 8 and the target surface 70 is displayed when another part of the blade edge of the bucket 8 is near the target surface 70. This prevents an operator from mistakenly operating to over-dig the target surface 70.

As shown in FIG. 9, distances D1 to D5 between each of the reckoned points C1 to C5 and the design surface 45 in the Ya-Za plane passing through each of the reckoned points C1 to C5 are calculated. Thus, an operator can easily ascertain the shortest distance in a direction parallel to the Ya-Za plane. When the operator operates the work machine 2, the operator normally moves the bucket 8 in a direction parallel to the Ya-Za plane. Thus, having the abovementioned distance-indicating information displayed in the guidance picture enables the operator to precisely ascertain the distance between the blade edge of the bucket 8 and the design surface 45 when operating the work machine 2.

In the side view 53*b* of the rough digging picture 53 and the side view 54*b* of the fine digging picture 54, the area closer to the ground than the design surface line 74 and the target surface line 79 and the area closer to the air than these line segments are shown in different colors. Thus, an operator can easily ascertain, when the blade edge of the bucket 8 is far away from the design surface 45, that the bucket 8 is positioned in an area where the design surface 45 is not present.

4. Other Embodiments

An embodiment of the present invention has been described above, but the present invention is not limited to this embodiment; various modifications are allowed to the extent that they remain within the spirit of the invention. The guidance pictures are not limited to those in the above description, and may be modified as appropriate. Some or all of the functions of the display controller 39 may be executed by a computer disposed outside the hydraulic shovel 100. The target work object is not limited to the plane described above, but may be a point, line, or three-dimensional shape. The input unit 41 of the display input device 38 is not limited to a touch panel, but may also comprise an operating member such as a hard key or a switch.

In the embodiment described above, an instance in which an operator performs digging operation manually by operating the work machine operating member 31 is described, an automatic digging mode may be additionally provided. When automatic digging mode has been selected, the target surface line 79 described above is a target movement path along which the blade edge of the bucket 8 is to be moved. The display controller 39 outputs a control signal for automatically moving the blade edge of the bucket 8 along the target movement path to the work machine control device 27. Herewith, the work machine 2 automatically executes digging.

In the embodiment described above, the work machine 2 has a boom 6, an arm 7, and a bucket 8, but the configuration of the work machine 2 is not limited thereto, and may have at least a bucket 8.

In the embodiment described above, the angles of inclination of the boom 6, arm 7, and bucket 8 are detected by the first through third stroke sensors 16 to 18, but the means for detecting the angles of inclination is not limited thereto. For example, an angle sensor for detecting the angles of inclination of the boom 6, arm 7, and bucket 8 may be provided.

The embodiment described above has a bucket 8, but the bucket is not limited thereto; it may instead be a tilting bucket. A tilting bucket comprises a bucket tilting cylinder and is a bucket that can shape and level an inclined surface or fiat ground to a desired shape by tilting to the left or right even when the hydraulic shovel is positioned on the inclined surface, and that can perform compaction work using a bottom plate.

In the embodiment described above, as shown in FIG. 9, five reckoned points C1 to C5 are set, but the number of reckoned points is not limited thereto as long as a plurality of reckoned points are set.

Figure 16:
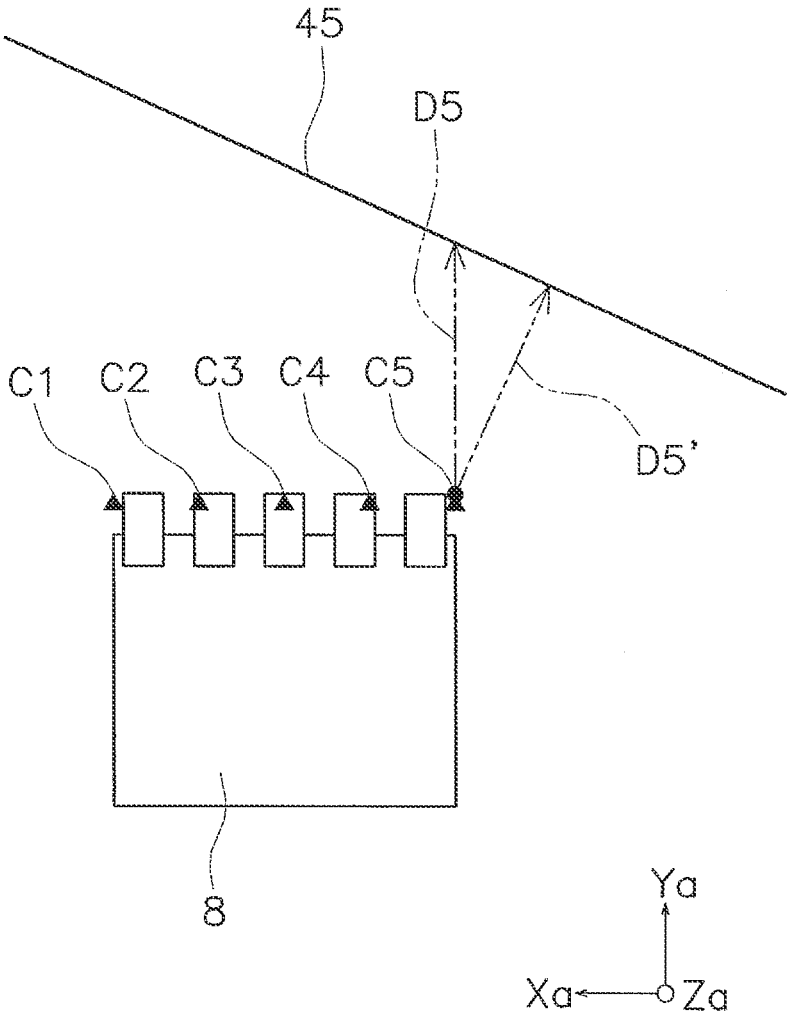
FIG. 16 shows a method of determining the shortest distance between a reckoned point and a design surface in another embodiment.

In the embodiment described above, as shown in FIG. 9, distances D1 to D5 between each of the reckoned points C1 to C5 and the design surface 45 in the Ya-Za plane passing through each of the reckoned points C1 to C5 are calculated. However, the shortest distance of the distances between the reckoned points C1 to C5 and the design surface 45 may be calculated regardless of the direction. For example, as shown in FIG. 16, rather than the shortest distance D5 on the Ya-Za plane passing through the reckoned point C5, the shortest distance D5' to the design surface 45 in any direction may be calculated for the reckoned point C5. In this case, an operator can easily ascertain the shortest distance between the design surface 45 and the position closest to the design surface 45 regardless of the direction in which the work machine 2 is being operated. For example, if the main vehicle body 1 of the hydraulic shovel 100 is tilted to the left or right, the bucket 8 may move not only in the drive direction of the work machine 2, but also in the widthwise direction of the work machine 2. Additionally, when the upper pivoting body 3 pivots, the bucket 8 moves in the widthwise direction. Thus, having the shortest distance in any direction displayed in the guidance picture enables an operator to precisely ascertain the distance between the blade edge of the bucket 8 and the design surfaces 45 when moving the main vehicle body 1.

Figure 17:
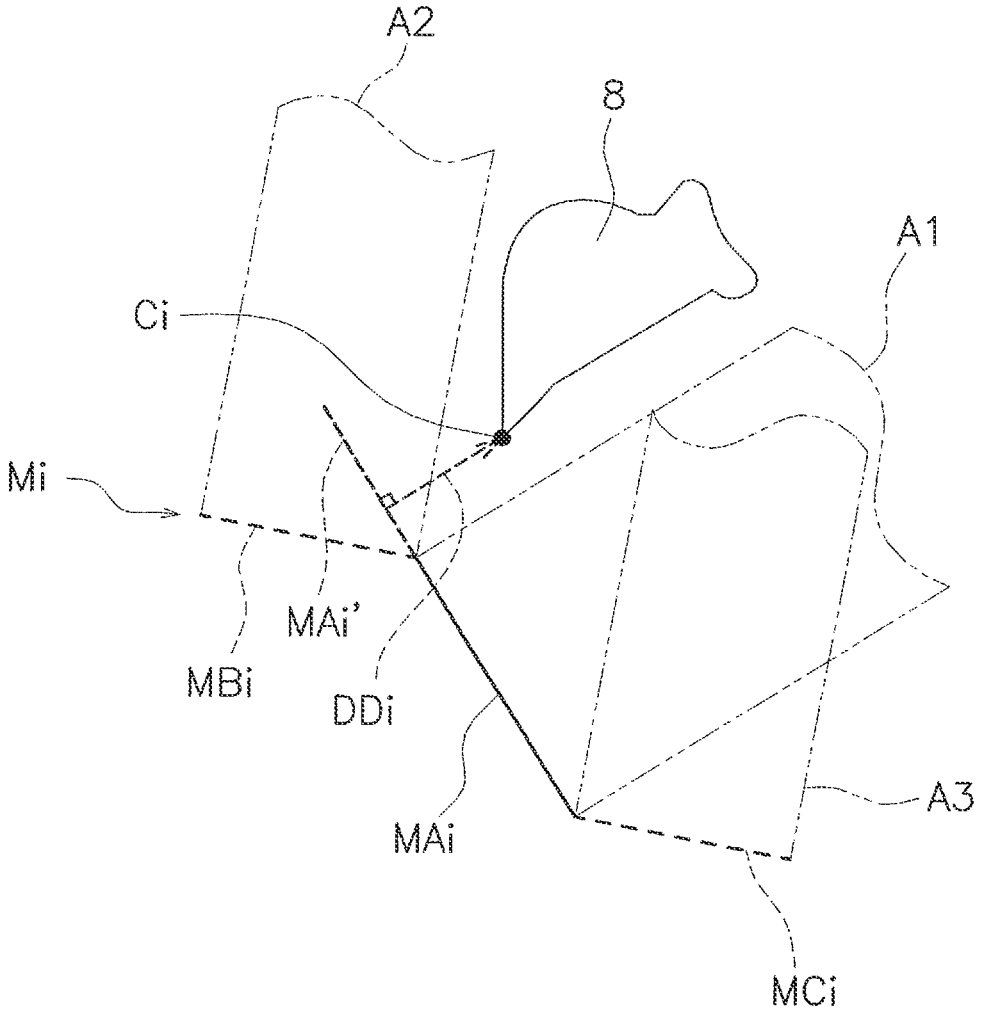
FIG. 17 shows a method of calculating the shortest distance when a reckoned point is positioned in a gap area between a target area and a first non-target area in another embodiment.

In the embodiment described above, when the blade edge of the bucket 8 is positioned in a gap area out of the target area A1, the distance between the i-th reckoned point Ci and the end point PAi indicating the outer boundary of the target surface 70 is calculated. However, the distance between the i-th reckoned point Ci and the extended plane of the target surface 70 may be calculated. Specifically, as shown in FIG. 17, the distance between the i-th reckoned point Ci and the extended line MAi' of the target line MAi may be calculated as the provisional target surface distance DDi. In this case, the target surface 70 can easily be shaped by operating the blade edge of the bucket 8 parallel to the target surface 70 from a position away from the target surface 70 (for example, a position on the extended plane of the target surface 70). It is thus possible, shaping after positioning the blade edge at the top of the slope prevents collapse of earth above the top of the slope, or neat shaping from being impeded by the shock of the work machine 2 when it begins to act.

The illustrated embodiment has an advantageous effect of enabling precise digging operation, and is effective as a display system in a hydraulic shovel and a control method therefor.

The invention claimed is:

1. A display system in a hydraulic shovel having a work machine including a bucket and a main body to which the work machine is attached, the display system comprising:

a position detector unit configured and arranged to detect information pertaining to a current position of the hydraulic shovel;

a storage unit configured and arranged to store positional information for a design surface indicating a target shape for a work object;

a calculation unit configured to calculate a position of a blade edge of the bucket based on the information pertaining to the current position of the hydraulic shovel, and to calculate a distance between the design surface and a position closest to the design surface among positions of the blade edge in a widthwise direction of the blade edge of the bucket based on positional information for the blade edge and the design surface; and a display unit configured and arranged to display a guidance picture including an image showing a positional relationship between the design surface and the blade edge of the bucket and information indicating the distance between the design surface and the position closest to the design surface.

2. The display system in the hydraulic shovel according to claim 1, wherein the image showing the positional relationship between the design surface and the blade edge of the bucket includes a front elevational view of the bucket; and the position closest to the design surface is displayed in the front elevational view of the bucket.

3. The display system in the hydraulic shovel according to claim 1, wherein a part of the design surface is selected as a target surface, and information indicating a distance between the target surface and a position closest to the target surface among positions of the blade edge in the widthwise direction of the blade edge is displayed in the guidance picture.

4. The display system in the hydraulic shovel according to claim 3, wherein information indicating a distance between a non-target surface excluding the target surface of the design surface and a position closest to the non-target surface among positions of the blade edge in the widthwise direction of the blade edge is displayed using a feature different from the information indicating the distance between the target surface and the position closest to the target surface, when the non-target surface is closer to the blade edge of the bucket than the target surface.

5. The display system in the hydraulic shovel according to claim 3, wherein information indicating a distance between an outer boundary of the target surface and a position closest to the outer boundary of the target surface among positions of the blade edge in the widthwise direction of the blade edge is displayed in the guidance picture, when the blade edge of the bucket is outside an area which is oriented perpendicular to the target surface.

6. The display system in the hydraulic shovel according to claim 5, wherein information indicating a smaller one of the distance between the outer boundary of the target surface and the position closest to the outer boundary of the target surface and the distance between the target surface and the position closest to the target surface among positions of the blade edge in the widthwise direction of the blade edge is displayed in the guidance picture, when a part of the blade edge of the bucket is outside the area which is oriented perpendicular to the target surface and another part of the blade edge of the bucket is within the area which is oriented perpendicular to the target surface.

7. The display system in the hydraulic shovel according to claim 3, wherein information indicating a distance between an extended plane of the target surface and a position closest to the extended plane of the target surface among positions of the blade edge in the widthwise direction of the blade edge is displayed in the guidance picture, when the blade edge of the bucket is out of an area which is oriented perpendicular to the target surface.

8. The display system in the hydraulic shovel according to claim 1, wherein a distance between the design surface and a position closest to the design surface among positions of the blade edge in a direction parallel to a plane perpendicular to the widthwise direction is calculated as the distance between the design surface and the position closest to the design surface.

9. The display system in the hydraulic shovel according to claim 1, wherein a shortest distance between the design surface and a position closest to the design surface among positions of the blade edge in any direction is calculated as the distance between the design surface and the position closest to the design surface.

10. The display system in the hydraulic shovel according to claim 1, wherein the image showing the positional relationship between the design surface and the blade edge of the bucket includes a line segment indicating a cross-section of the design surface as seen from a side of the main body, and an area closer to the ground than the line segment and an area closer to the air than the line segment are shown in different colors.

11. A hydraulic shovel including the display system in the hydraulic shovel according to claim 1.

12. A method of controlling a display system in a hydraulic shovel including a work machine including a bucket and a main body to which the work machine is attached, the method comprising:

detecting information pertaining to a current position of the hydraulic shovel with a position detector unit;

calculating a position of a blade edge of the bucket based on information pertaining to the current position of the hydraulic shovel with a display controller;

calculating a distance between a design surface indicating a target shape of a work object and a position closest to the design surface among positions of the blade edge in a widthwise direction of the blade edge based on positional information for the design surface and the position of the blade edge of the bucket with the display controller; and displaying a guidance picture including an image showing a positional relationship between the design surface and the blade edge of the bucket and information indicating the distance between the design surface and the closest position.

* * * * *